US008029105B2

(12) United States Patent
Sieber et al.

(10) Patent No.: US 8,029,105 B2
(45) Date of Patent: Oct. 4, 2011

(54) AMBIENT PLASMA TREATMENT OF PRINTER COMPONENTS

(75) Inventors: Kurt D. Sieber, Rochester, NY (US); Jeremy M. Grace, Penfield, NY (US); Gilbert A. Hawkins, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 883 days.

(21) Appl. No.: 11/873,655

(22) Filed: Oct. 17, 2007

(65) Prior Publication Data

US 2009/0102886 A1 Apr. 23, 2009

(51) Int. Cl.
*B41J 2/05* (2006.01)

(52) U.S. Cl. ..... 347/56; 347/44; 347/47

(58) Field of Classification Search ..... 347/44, 347/45, 47, 54–59
See application file for complete search history.

(56) References Cited

U.S. PATENT DOCUMENTS

| | | | |
|---|---|---|---|
| 3,705,055 | A | 12/1972 | Christensen et al. |
| 3,875,068 | A | 4/1975 | Mitzel |
| 3,879,597 | A | 4/1975 | Bersin et al. |
| 4,088,926 | A | 5/1978 | Fletcher et al. |
| 4,472,467 | A | 9/1984 | Tamaki et al. |
| 4,717,631 | A | 1/1988 | Kaganowicz |
| 4,719,477 | A | 1/1988 | Hess |
| 4,740,410 | A | 4/1988 | Muller et al. |
| 5,124,173 | A | 6/1992 | Uchiyama et al. |
| 5,136,310 | A | 8/1992 | Drews |
| 5,202,705 | A | 4/1993 | Asano et al. |
| 5,218,381 | A | 6/1993 | Narang et al. |
| 5,414,324 | A | 5/1995 | Roth et al. |
| 5,425,980 | A | 6/1995 | Grace et al. |
| 5,514,936 | A | 5/1996 | Williamson et al. |
| 5,576,076 | A | 11/1996 | Slootman et al. |
| 5,610,335 | A | 3/1997 | Shaw et al. |
| 5,714,308 | A | 2/1998 | Romach et al. |
| 5,790,146 | A | 8/1998 | Anderson |
| 5,942,855 | A | 8/1999 | Hopwood |
| 5,961,772 | A | 10/1999 | Selwyn |
| 6,082,292 | A | 7/2000 | Denes et al. |
| 6,127,198 | A | 10/2000 | Coleman et al. |
| 6,193,352 | B1 | 2/2001 | Sharma et al. |
| 6,243,112 | B1 | 6/2001 | Kuhman et al. |
| 6,325,490 | B1 | 12/2001 | Yang et al. |

(Continued)

FOREIGN PATENT DOCUMENTS

| | | |
|---|---|---|
| EP | 1 306 214 | 3/2009 |

(Continued)

OTHER PUBLICATIONS

Martinu et al., "Plasma Deposition of Optical Films and Coatings: A Review", *J. Cac. Sci. Technol.* A 18(6), Nov./Dec. 2000.

(Continued)

*Primary Examiner* — Juanita D Stephens
(74) *Attorney, Agent, or Firm* — William R. Zimmerli

(57) ABSTRACT

A method of treating a printer component, a printhead, and a printer are provided. The method includes providing an electrode proximate to the printer component to be treated; introducing a plasma treatment gas in an area proximate to the printer component to be treated; and treating the printer component by applying power to the electrode thereby producing a micro-scale plasma at near atmospheric pressure, the micro-scale plasma acting on the printer component.

19 Claims, 14 Drawing Sheets

U.S. PATENT DOCUMENTS

| | | | | |
|---|---|---|---|---|
| 6,399,159 | B1 | 6/2002 | Grace et al. | |
| 6,444,275 | B1 | 9/2002 | Kuhman | |
| 6,488,357 | B2 | 12/2002 | Skinner et al. | |
| 6,517,187 | B1 | 2/2003 | Dietl | |
| 6,603,121 | B2 | 8/2003 | Grace et al. | |
| 6,666,449 | B2 | 12/2003 | DeFosse et al. | |
| 6,695,664 | B2 | 2/2004 | Eden et al. | |
| 6,726,304 | B2 | 4/2004 | Fassler et al. | |
| 6,827,870 | B1 | 12/2004 | Gianchandani et al. | |
| 6,926,394 | B2 | 8/2005 | Bowling | |
| 7,041,608 | B2 | 5/2006 | Sieber et al. | |
| 7,172,267 | B2 * | 2/2007 | Furukawa | 347/55 |
| 7,516,549 | B2 * | 4/2009 | Asuke | 29/890.1 |
| 2002/0022139 | A1 | 2/2002 | Kotera et al. | |
| 2002/0113553 | A1 | 8/2002 | Vojak et al. | |
| 2003/0132693 | A1 | 7/2003 | Eden et al. | |
| 2004/0144733 | A1 | 7/2004 | Cooper et al. | |
| 2004/0164682 | A1 | 8/2004 | Hopwood et al. | |
| 2005/0168527 | A1 | 8/2005 | Miyakawa et al. | |
| 2005/0185016 | A1 | 8/2005 | Mori et al. | |
| 2006/0028145 | A1 | 2/2006 | Mohamed et al. | |
| 2006/0132541 | A1 | 6/2006 | Nishijima | |
| 2006/0221144 | A1 | 10/2006 | Nagashima | |
| 2007/0029500 | A1 | 2/2007 | Coulombe et al. | |

FOREIGN PATENT DOCUMENTS

| | | |
|---|---|---|
| JP | 60-204372 | 10/1985 |

OTHER PUBLICATIONS

Bardos et al., "Characterization of Hybrid Atmospheric Plasma in Air and Nitrogen", *Vacuum Technology & Coating* 7(12) 44-47 (2006).

Lieberman et al., *Principles of Plasma Discharges and Materials Processing*, John Wiley & Sons, Inc., New York (1994).

Stoffels et al., "Superficial Treatment of Mammalian Cells Using Plasma Needle", *J. Phys. D: Appl. Phys.* 36 (2003) 2908-2913.

F. M. Penning, *Electrical Discharges in Gases*, Gordon and Breach, New York 1965.

* cited by examiner

AMBIENT PLASMA TREATMENT OF PRINTER COMPONENTS

FIELD OF THE INVENTION

The present invention relates generally to printing systems and, in particular to cleaning or treating inkjet printer components or devices.

BACKGROUND OF THE INVENTION

The operation of inkjet printing devices relies on stable surface properties of particular components, including nozzle plate surfaces, nozzle bore surfaces, and surfaces of drop catching mechanisms, such as gutters or drop catchers. For example, Coleman et al. in U.S. Pat. No. 6,127,198 discuss the need to have hydrophilic surfaces internal to the fluid injector of an ink jet device and hydrophobic properties on exterior surfaces such as the nozzle front face. Bowling in U.S. Pat. No. 6,926,394 describes the need for a hydrophobic surface on a drop catcher for continuous ink jet printers.

The surface properties of a component are affected by its surface chemical composition and degree of contamination from a variety of sources, such as hydrocarbon compounds in the room air, debris such as skin flakes and dust particles, and deposited particulate from inks. Consequently, cleaning and maintenance of inkjet print device components is critical to consistent printing performance.

One common technique to clean surfaces for inkjet printing devices includes washing in a cleaning solution, see, for example, Sharma et al, U.S. Pat. No. 6,193,352; Fassler et al., U.S. Pat. No. 6,726,304, and Andersen, U.S. Pat. No. 5,790,146. However, washing inkjet device components in cleaning solutions is not a practicable maintenance approach, as it requires providing a bath of cleaning solution and generally requires removal of the device from the printer. Hence, it is preferable to apply surface coatings to device components and to clean the device components by techniques that can be implemented in-situ.

Another common technique to prepare surfaces for inkjet printing devices includes applying hydrophobic or lyophobic coatings like those described in Coleman et al., U.S. Pat. No. 6,127,198 (diamond-like carbon with fluorinated hydrocarbon); Yang et al. in U.S. Pat. No. 6,325,490 (self assembled monolayers of hydrophobic alkyl thiols); Drews, U.S. Pat. No. 5,136,310 (alkyl polysiloxanes and variants thereof); Narang et al., U.S. Pat. No. 5,218,381 (silicone doped epoxy resins); and Skinner et al., U.S. Pat. No. 6,488,357 (gold, coated with an organic sulfur compound). However, this approach has limitations. For example, coatings tend to foul with device usage.

Another common technique for surface cleaning includes wiping surfaces with "blades" of rubber or some other suitably soft material, see, for example, Dietl et al., U.S. Pat. No. 6,517,187; and Mori et al. US Patent Application Publication No. 2005/0185016. However, this approach has limitations. For example, wiping can eventually degrade the non-wetting character of the device surface.

Given the limitations of current approaches to maintaining critical surface properties of inkjet printing device components, it would be advantageous to clean and prepare surfaces on components of fully assembled printing devices without having to remove them so that desirable surface conditions could be restored or maintained periodically or as needed. It would also be advantageous to use processes with reduced materials and energy consumption.

Plasma processes for coating and cleaning in general make more efficient use of materials than liquid-based processes. Furthermore, a wide variety of materials can be prepared and deposited using plasmas. For example, polymer materials can be formed by plasma polymerization by feeding monomer material into a plasma environment, as described in *Plasma Polymerization*, H. Yasuda, Academic 1985; by Kuhman et al. in U.S. Pat. No. 6,444,275 (depositing fluoropolymer films on thermal ink jet devices); and by DeFosse et al. in U.S. Pat. No. 6,666,449 (depositing fluoropolymer films on star wheel surfaces).

Kuhman et al. in U.S. Pat. No. 6,243,112 also describe the use of plasma processes to deposit diamond-like carbon, and further using plasma processing in fluorine bearing gases to fluorinate the diamond-like carbon film. Semiconductor (e.g., Si) oxides or nitrides and metal (e.g., Ta) oxides or nitrides can be deposited by feeding semiconductor or metal bearing precursor vapor and respective oxygen or nitrogen bearing gas into a plasma environment, as discussed by Martinu and Poitras (J. Vac. Sci. Technol. A 18(6), 2619-2645 (2000)); Kaganowicz et al. in U.S. Pat. No. 4,717,631 (describing the use of plasma enhanced chemical vapor deposition (PECVD) to form silicon oxynitride passivation layers from a mixture of $SiH_4$, $NH_3$, and $N_2O$ precursors); Hess in U.S. Pat. No. 4,719,477 (describing the use of PECVD to deposit silicon nitride on tungsten conductive traces in fabrication of a thermal ink jet printhead); and Shaw et al. in U.S. Pat. No. 5,610,335 (describing the use of PECVD oxide to passivate trench sidewalls in fabrication of a micromechanical accelerometer).

Plasmas are also well known for etching and cleaning applications. Oxygen bearing plasmas in particular are well known for removal of organic and hydrocarbon residue, see, for example, Fletcher et al, U.S. Pat. No. 4,088,926, Williamson et al., U.S. Pat. No. 5,514,936), and for removal (commonly referred to as ashing) of residual photoresist materials in semiconductor processing, see, for example, Christensen et al., U.S. Pat. No. 3,705,055, Mitzel, U.S. Pat. No. 3,875,068, Bersin et al., U.S. Pat. No. 3,879,597, and Muller et al., U.S. Pat. No. 4,740,410.

In common plasma processing as described above, the cleaning, etching, or deposition process is carried out at reduced pressure (typically below 2 mBar, or 200 Pa, or roughly 1.5 Torr), thus requiring the treatment process to be carried out in a vacuum chamber. Because of the controlled environment that the vacuum enclosure affords, a wide variety of etching, cleaning, surface chemical modification, and deposition processes are readily practicable in these low-pressure plasma processes.

Atmospheric pressure plasmas are also known. In contrast to the low-pressure plasma processes, plasmas run in ambient air are generally limited to cleaning and surface chemical modification processes based on activated oxygen species. Typical atmospheric pressure plasmas used in industrial applications are corona discharges and dielectric barrier discharges. The dielectric barrier discharge, in particular, is well known in ozone generation for water purification and for polymer surface modification applications in coating, lamination, and metallization processes. In contrast to low-pressure plasmas, which operate at values of Pd (the product of pressure P and electrode gap d) below the minimum on the Paschen curve (i.e., the break down voltage Vas a function of Pd), these high-pressure plasmas operate at Pd values above the minimum in the curve and typically operate an order of magnitude higher in applied voltage. While the corona discharge has diffuse glow-like characteristics, it typically can support low power densities. The dielectric barrier discharge, typically driven at low radio frequency (i.e., approximately 10 kHz to 100 kHz) to mid radio frequency (i.e., approximately 100 kHz to 1 MHz) can support higher power densities, and electrical breakdown proceeds by avalanche effects and streamer formation. Local charging of the dielectric barrier sets up an opposing electric field that shuts down the streamers and prevents formation of arcs (high-current, low-voltage discharges where the gas is heated sufficiently to produce significant ionization). By alternating the high voltage applied to the discharge gap, streamers are formed in opposite directions each half cycle. The dielectric barrier discharge has proven useful in the printing industry as a means of modifying substrates surfaces to accept inks. The high voltage operation (10 kV or greater) and the filamentary nature of this discharge present serious limitations for extending this technology to other applications.

While atmospheric pressure plasmas, such as DBDs are often applied in surface modification of polymers and in treatment of gases for pollution abatement, atmospheric pressure plasmas have also been developed for plasma deposition processes. Examples include the DBD-based process described by Slootman et al. in U.S. Pat. No. 5,576,076 for coating $SiO_x$ in roll-to-roll format; APGD to deposit thin fluorocarbon layers on organic light emitting diode devices as described by Sieber et al., in U.S. Pat. No. 7,041,608; and hybrid hollow cathode microwave discharges to deposit diamond-like carbon described by Bardos and Barankova, in "Characterization of Hybrid Atmospheric Plasma in Air and Nitrogen", Vacuum Technology & Coating 7(12) 44-47 (2006).

In large-area plasma modification processes, the high operating voltages and spatial non-uniformity of the dielectric barrier discharges (DBDs) have often proven undesirable. Efforts to achieve the uniform glow-like character of low-pressure discharges at atmospheric pressure (atmospheric pressure glow discharge or APGD) have used a variety of techniques, including adding helium and other atomic gases to dielectric barrier discharges and/or carefully selecting driving frequency and impedance matching conditions under which a dielectric barrier discharge is run, see, for example, Uchiyama et al, U.S. Pat. No. 5,124,173; Roth et al., U.S. Pat. No. 5,414,324; and Romach et al., U.S. Pat. No. 5,714,308. Other approaches not requiring a dielectric barrier include using helium and radiofrequency power (e.g., 13.56 MHz) in combination with appropriate electrode configuration, see, for example, Selwyn, U.S. Pat. No. 5,961,772 (describing an atmospheric pressure plasma jet), and scaling a plasma source to dimensions at which Pd values nearer the Paschen minimum can be achieved at higher pressures than typical low-pressure discharges, see, for example, Eden et al. U.S. Pat. No. 6,695,664 and Cooper et al., US Patent Application Publication No. 2004/0144733 (describing microhollow cathode discharges).

In typical plasma cleaning and plasma treatment processes, the article to be treated or cleaned is either placed in a treatment chamber wherein plasma is generated (i.e. a process with stationary substrates), or it is conveyed through a plasma zone (i.e., a process with translating substrates). An example of the former mode of process is plasma ashing of photoresist in semiconductor manufacturing (see previously cited references). In these applications, the electrode system is generally independent of the article to be treated, and the surface of the article is generally at floating potential (i.e., the potential that an electrically insulated object naturally acquires when presented to the plasma, such that the object draws no net electrical current; generally this potential is approximately 10-20 volts below the plasma potential, the difference depending on the electron temperature in the plasma, see, for example, Principles of Plasma Discharges and Materials Processing, by M. A. Lieberman and A. J. Lichtenberg, Wiley, New York (1994). An example of the latter mode, wherein the article to be treated is conveyed through a plasma zone, is plasma treatment of polymer webs, see, for example, Grace et al., U.S. Pat. No. 5,425,980; Tamaki et al., U.S. Pat. No. 4,472,467; and Denes et al., U.S. Pat. No. 6,082,292.

In some web treatment techniques, the web is electrically floating whereas in other techniques, the web is placed in the cathode sheath, see, for example, Grace et al., U.S. Pat. No. 6,603,121; and Grace et al., U.S. Pat. No. 6,399,159, and experiences energetic bombardment from ions accelerated through the high-voltage sheath (as is typical in plasma etching processes used in fabrication of microelectronic circuits on silicon wafers). In these approaches, the entire substrate surface presented to the plasma is treated. Furthermore, neither of these approaches is compatible with treating inkjet printing device components without removing them from the inkjet printing system.

Regardless of pressure range of operation, typical plasma processing techniques employ macroscopic plasmas, and the process powers and areas tend to be high. For example, typical power supplies for etching semiconductor wafers are capable of delivering 1-5 kW and wafer areas are typically in the range 180 $cm^2$ to 700 $cm^2$. Power supplies for plasma web treatment devices generally are capable of delivering 1-10 kW for web widths of 1-2 m and treatment zones of order 0.3 m long. Consequently, adapting such large-scale approaches to processing only a small fraction of a device surface area would make inefficient use of energy and would possibly limit the process speed for lack of ability to provide required local energy densities, which would need to be applied over the large volumes or areas involved in such large-scale approaches. Additionally, plasma sensitive components in the device can be damaged by exposure of the device to large-scale plasmas.

Micro-scale plasmas (i.e., a plasma characterized by having sub-millimeter extent in at least one dimension) provide localized plasma processing and, as mentioned above, higher operating pressures by virtue of Pd scaling. An example of localized plasma processing using micro-scale plasmas is the use of patterned plasma electrodes to produce micro-scale plasma regions over a substrate to add material or remove material in a desired pattern, as described by Gianchandani et al. in U.S. Pat. No. 6,827,870. Etch process results are disclosed for applied power densities in the range 1-7 $W/cm^2$ and gas pressures in the range 2-20 Torr. While these pressures are significantly higher than traditional low-pressure plasma processes (i.e., <1 Torr), they are considerably lower than atmospheric pressure (760 Torr) and, therefore, Gianchandani does not teach or disclose the design of the micro-scale discharge source to operate at near atmospheric pressures.

The micro-hollow-cathode source of Cooper et al. is aimed at providing intense ultraviolet light for water purification and is shown to operate at higher pressures (200-760 Torr) than disclosed by Gianchandani. The object of the more recently disclosed micro-hollow-cathode source of Mohamed et al., US Patent Application Publication No. US 2006/0028145 is to produce a micro plasma jet at atmospheric pressure. In the former case, the ability to produce the requisite ultraviolet emission depends on the choice of discharge gas and operating conditions of the device. In the latter case, the microhollow cathode device also serves as a gas nozzle, and the jet characteristics depend on nozzle design and flow conditions as well as the plasma conditions.

Other examples of atmospheric pressure micro-scale plasma sources include the plasma needle described by Stoffels et al. (Superficial treatment of mammalian cells using plasma needle; Stoffels, E.; Kieft, I. E.; Sladek, R. E. J. Journal of Physics D: Applied Physics (2003), 36(23), 2908-2913), the narrow plasma jet disclosed by Coulombe et al., US Patent Application Publication No. 2007/0029500; the microcavity array of Eden et al., US Patent Application Publication No. S 2003/0132693; the multilayer ceramic microdischarge device described by Vojak et al., US Patent Application Publication 2002/0113553; and the low-power plasma generator of Hopwood et al., US Patent Application Publication No. 2004/0164682. The plasma needle of Stoffels et al. is aimed at surface modification of living cells in mammalian tissue. The narrow plasma jet of Coulombe et al. is also directed toward biological applications, such as skin treatment, etching of cancer cells and deposition of organic films. The microcavity array of Eden et al. is aimed at light emitting devices, and the multilayer ceramic microdischarge device of Vojak et al is directed toward light emitting devices or microdischarge devices integrated with multilayer ceramic integrated circuits. The low power plasma generator of Hopwood et al., which employs a high-Q resonant ring with a discharge gap, is directed towards portable devices and applications such as bio-sterilization, small-scale processing, and microchemical analysis systems. In addition to the glow-like character of these discharges, they generally operate at or near atmospheric pressure, and they are spatially localized. Hence, plasma processing of selected localized areas at atmospheric pressure, with operating characteristics similar to low pressure plasmas is possible.

The micro-scale atmospheric pressure plasma sources mentioned above might produce useful localized plasma processing for cleaning or treatment of ink jet printing device components. In none of these cases is there mention of applying plasma treatment selectively to localized areas of a printer component or device, such as an ink jet print head, that contains sensitive electronics, such as CMOS logic and drivers, nor is their concern for rapid processing times that would require generation of significant localized fluxes of reactive species in specific regions of a component in order to process the component in with reasonable process time and minimal damage thereto. Furthermore, none of these cases teaches integration of the micro-scale discharge electrode system directly into a device designed for printing, wherein components of the printing device serve as part of the electrode system for generation of the plasma, nor do they teach the use of micro-scale discharges to clean, prepare, or otherwise maintain the surface properties of inkjet printing components.

While one of ordinary skill in the art of printing might be familiar with dielectric barrier discharges or variants thereof for surface treatment of printing substrates because printing processes run at atmospheric pressure, most plasma processes that run under vacuum conditions would be considered prohibitive from the standpoint of workflow and capital cost. The ability to run a plasma process at atmospheric pressure with characteristics similar to those of vacuum plasma processes and with the potential to introduce specific plasma chemistries tailored for cleaning, etching, or deposition is highly desirable and is not known in the printing art. It is further desirable to have the ability to carry out such processes effectively, using geometries compatible with inkjet printer components, without mechanical or electrical damage to critical components of the printing system. The integration of plasma technologies into the printing system for applications other than printing or substrate modification is highly desirable.

Thus, there is a need for a plasma treatment process integrated with an inkjet printing system and operable without causing damage to printing device components.

SUMMARY OF THE INVENTION

According to one aspect of the invention, a method of treating a printer component includes providing an electrode proximate to the printer component to be treated; introducing a plasma treatment gas in an area proximate to the printer component to be treated; and treating the printer component by applying power to the electrode thereby producing a micro-scale plasma at near atmospheric pressure, the micro-scale plasma acting on the printer component.

According to another aspect of the invention, a printhead includes a nozzle bore and a liquid chamber in liquid communication with the nozzle bore. A drop forming mechanism is associated with one of the nozzle bore and the liquid chamber. Electrical circuitry is in electrical communication with the drop forming mechanism. An electrical shield is integrated with the printhead to shield at least one of the drop forming mechanism and the electrical circuitry from an external source of power.

According to another aspect of the invention, a printer includes a printer component and at least one electrode integrated with the printer component. The at least one electrode is configured to produce a micro-scale plasma at near atmospheric pressure proximate to the printer component.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described can take various forms well known to those skilled in the art.

An ink jet printer contains multiple printer components or devices. The term component(s), the term device(s), and the term printer component(s) are used interchangeably, and they refer to mechanical, optical, electro-optical, electromechanical, or electrical sub-assemblies in the inkjet printer. An inkjet printing device is an assembled collection of printer components or devices that, when properly interconnected, are capable of producing a printed image on a substrate. A printer component is any assembly or device in the inkjet printer that is employed at any time during inkjet printer function or operation, regardless of purpose. A printer component can also be comprised of several devices, components, or subassemblies. Printer components serve of a broad range of functions. For example, they can be dedicated to substrate transport, ink delivery to the substrate, or ink management. Ink or fluid management may include delivering ink to an intended destination within the printer, reclaiming and recycling unprinted ink as well as fluid filtration. Printer components or devices that are dedicated to the production of drops or droplets include the inkjet printhead.

Figure 1:
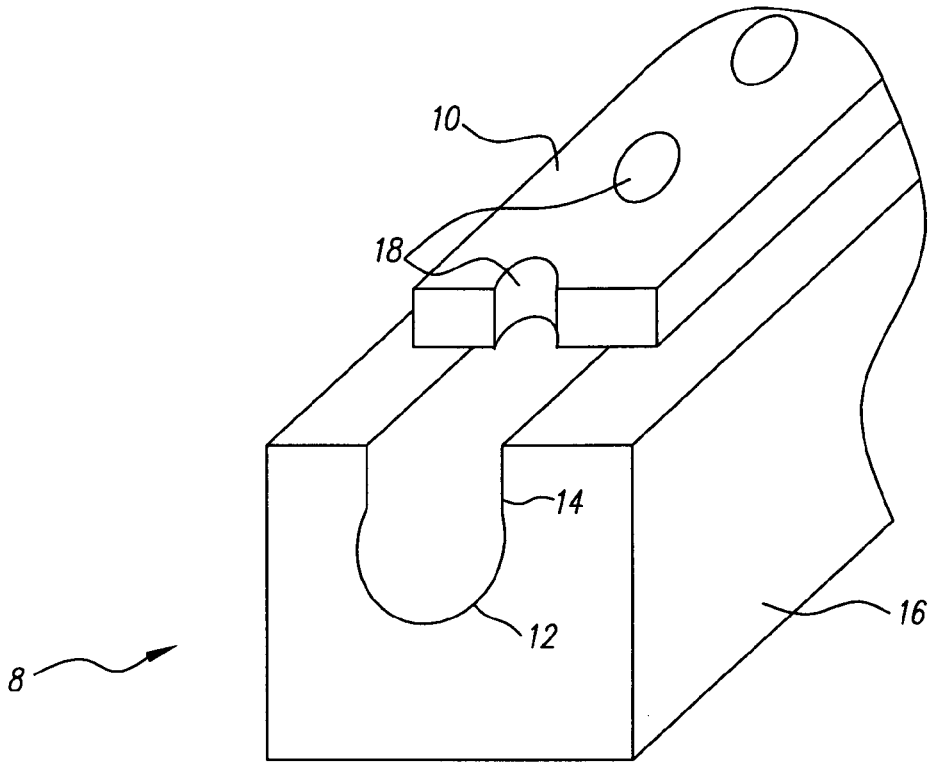
FIG. 1 is a cross-sectional view of an inkjet printhead.

Referring to FIG. 1, a schematic of one type of printer component, a printhead 8 is shown. The printhead 8 comprises a fluid delivery manifold 16 including a chamber often referred to as a liquid chamber or manifold bore 12 through which ink and other fluids pass to a nozzle plate 10. A fluid pathway often referred to as a slot 14 which is used to direct the fluid to the nozzle plate 10 from the manifold bore 12 is located between the nozzle plate 10 and the manifold bore 12. The nozzle plate or orifice plate 10 includes at least one nozzle bore 18 that is an orifice of defined cross section and length. Additional fluid pathways can be present between the orifice of the nozzle bore and the slot (such additional features not shown). Single or multiple nozzle bores are included in the nozzle plate or orifice plate. The term nozzle plate or orifice plate is familiar to those knowledgeable in the art of inkjet printing.

The fluid or ink travels from the manifold bore through the slot to the nozzle bore in the nozzle plate and is ejected in the form of drops or droplets. A drop forming mechanism can be associated with the nozzle bore and/or the liquid chamber. The drop forming mechanism can be an electrical, mechanical, electromechanical, thermal, or fluidic mechanism, and is familiar to those knowledgeable in the art of inkjet printing. For example, drop forming mechanisms can include single or multiple heating elements either near the nozzle bore or as an integral part of the nozzle bore. Additionally, piezoelectric transducers can be located at or near the nozzle bore.

The nozzle plate or orifice plate containing one or more nozzle bores can include electrical circuitry or complex microelectronic circuitry dedicated to various purposes such as producing drops or droplets and providing a means for electrical communication to the drop forming mechanism associated with at least one of the nozzle bores to provide a means for controlling the drop forming mechanism associated with at least one nozzle bore on the nozzle plate. The electrical circuitry can also perform other functions such as monitoring temperature or pressure. The nozzle plate or the manifold can include other assemblies for injecting energy into a jet of liquid or fluid emerging from the nozzle bore orifices on the nozzle plate for the purpose of producing drops.

The printhead 8 can be incorporated into either a drop on demand printer or a continuous printer. When incorporated into a continuous printer, ink and/or other fluids that pass through the nozzle plate and that are not printed on a substrate can be collected for reuse using printer devices or components familiar to those knowledgeable in the art of inkjet printing. These devices or components are called gutters and are dedicated to collecting unprinted drops or droplets so that the fluid can be reused. The gutter thus contains at least one surface for collecting fluid and a means for directing the collected drops and fluid to a fluid delivery system so that it can be reused.

Figure 2:
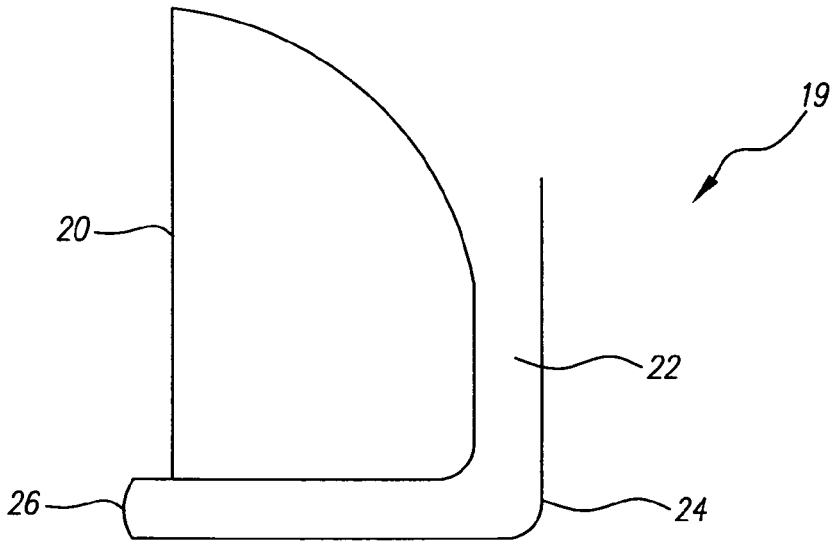
FIG. 2 is a schematic of a gutter used in an inkjet printer.

FIG. 2 shows a schematic for one design of a printer component known as a gutter 19. Unprinted fluid from an inkjet printhead is collected on a gutter collection surface 20 and flows through a fluid collection channel 22 formed in the space between the fluid collection channel wall 24 and the gutter collection surface 20 to a drain 26. In other gutter designs unprinted fluid can be collected on the fluid collection channel wall 24 and then flow into fluid collection channel 22. The unprinted fluid, ink or otherwise, is then removed from the drain for recycling or discarding to waste. Typically, the drain is connected to a controlled vacuum, resulting in fluid removal from the fluid collection channel by suction, so that both gas and liquid can flow through the fluid collection channel.

Continuous printers include other devices or printer components in the printing device are dedicated to controlling the trajectory of drops and droplets or deflecting drops or droplets using any means of trajectory control known in the art. Such inkjet printer components are known as drop deflectors or droplet deflectors. In general, drop deflectors are positioned between an inkjet printhead that serves to produce the drops and a gutter that serves to collect fluid and ink for recycling or discarding to waste. Several means of controlling drop trajectory and introducing drop or droplet deflection by employing a drop deflector are known in the art and are familiar to those knowledgeable in the art of inkjet printing. For example, the trajectory of drops can be controlled by means of deflection of charged drops in an electric field, deflection of drops through the action of an air flow at either elevated or reduced pressure, deflection of drops by means of unbalanced thermal stimulation of a jet of liquid, or any other means familiar to those skilled in the art of inkjet printing.

Electrostatic deflection methods employ electrically conductive assemblies of wires, plates, or variously shaped conductive tunnels. These devices are called electrostatic deflection devices or electrostatic deflection inkjet printer components and include components such as charge plates and charge tunnels that are familiar to those knowledgeable in the art of inkjet printing.

Figure 3:
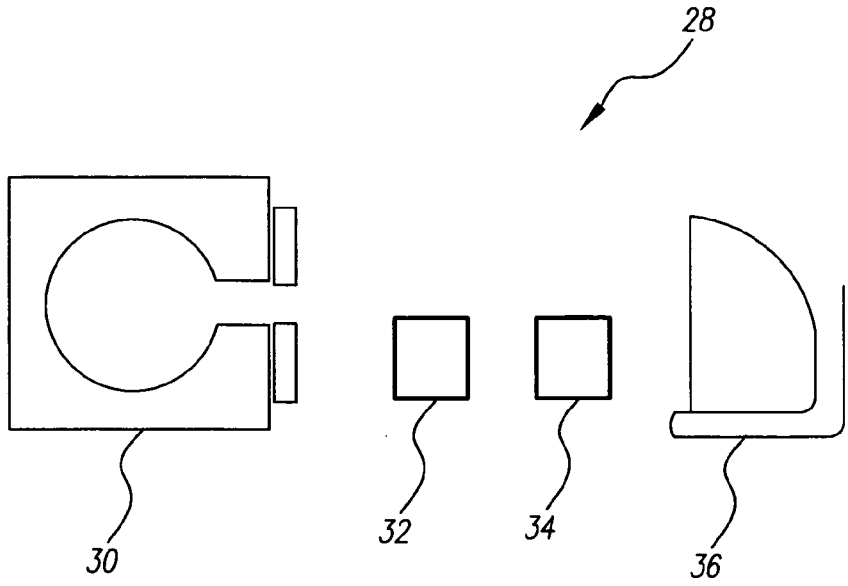
FIG. 3 shows a deflection mechanism for electrostatic deflection.

FIG. 3 shows a schematic of an electrostatic deflection inkjet printer component. This inkjet printer component is also known as an electrostatic drop deflector 28. The electrostatic deflection inkjet printer component is located between the inkjet printhead 30 and the inkjet printer gutter 36. The electrostatic deflection inkjet printhead component is comprised of at least one charging electrode 32 and at least one deflection electrode 34. Such assemblies are familiar to those skilled in the art of continuous inkjet printing.

In operation, drops or droplets are formed from a liquid jet emanating from a nozzle bore in the nozzle plate located on the manifold, and the drops are charged through the action of an electric field applied by the charging electrode 32. The charged drops can then be deflected by the deflection electrode 34 for the purpose of either directing the drops for collection on the collection surface of the gutter 36 or for the purpose of directing the drops to a substrate for the purpose of printing text or images through the selective imagewise deposition of drops or droplets on a substrate.

In air or gas deflection methods, the droplet deflector is configured to generate a gas flow interacting with the ink droplets, thereby separating ink droplets having one of a plurality of volumes from ink droplets having another of said plurality of volumes. The air drop deflector can also employ a pressure sensor positioned proximate to the output of the drop deflector component, where the pressure sensor is configured to generate a pressure indication signal. Additionally, a controller coupled to said pressure sensor and configured to output a compensation signal based on the indication signal can be employed to provide an adjustment mechanism operatively coupled to said droplet deflector to adjust the gas flow generated by said droplet deflector in response to the compensation signal.

Figure 4:
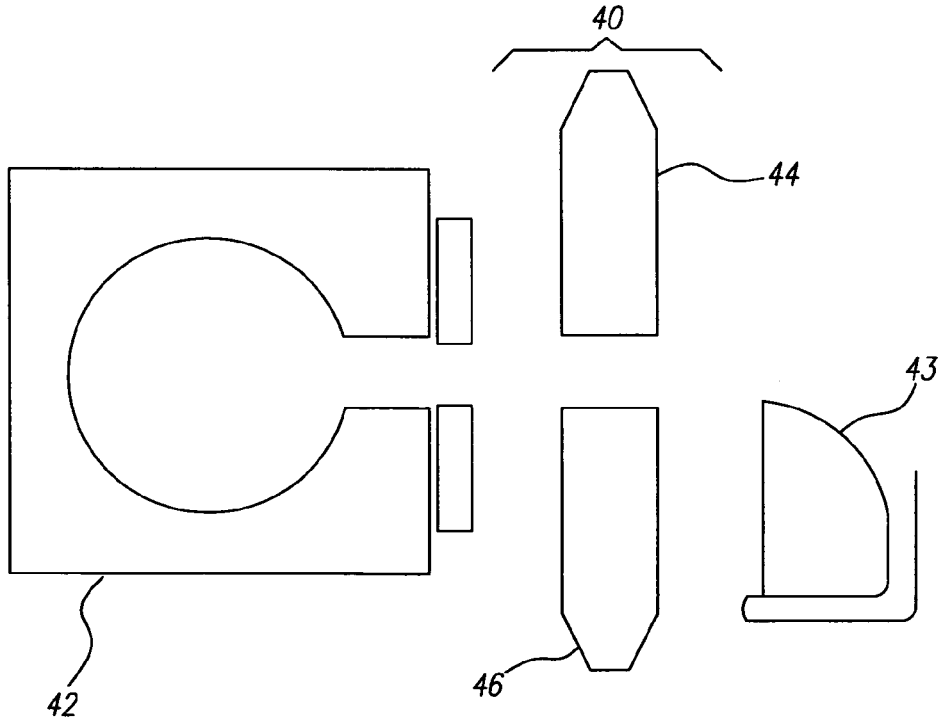
FIG. 4 shows a schematic for a deflection mechanism using air flow.

FIG. 4 shows a schematic of a drop deflector 40 using a gas flow. Drops are provided by the inkjet printhead 42 and fluid and inks that are to be recycled or discarded to waste are collected by the gutter 43. A gas flow is supplied by gas supply manifold 44 and collected by gas removal manifold 46 to provide a controlled gas flow between the gas supply manifold and gas removal manifold for the purpose of deflecting drops passing from the inkjet printhead towards the paper (or substrate) in the direction of the gutter. The gas removal manifold 46 can operate under reduced pressure so that, if desired, the gas supply manifold is not required for drop deflection.

Figure 5:
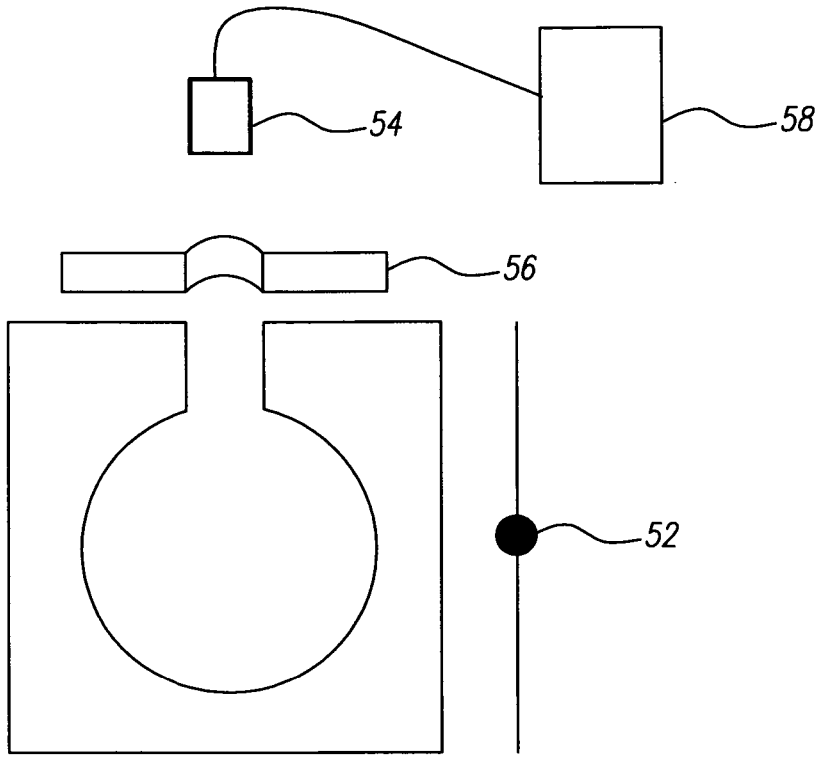
FIG. 5 shows a single electrode positioned over an inkjet printhead printer component.

In order to employ micro-scale plasmas to clean, treat, or otherwise process critical surfaces of the various inkjet printer components such as those described above, a micro-scale plasma is introduced either external to or in integrated fashion with the inkjet printer component. FIG. 5 illustrates an inkjet printhead 52 with an electrode 54 positioned above the nozzle plate 56. The electrode 54 is used for the purpose of creating a micro-scale plasma proximate to the inkjet printer component, which in this example is the inkjet printhead. As used herein, proximate refers to distances within 1 cm from the component. The formation of a micro-scale plasma proximate to the inkjet printhead component can serve many purposes including ensuring initial cleanliness of the surfaces of the inkjet printer component, as well as surface modification of the surfaces of the inkjet printer component for the purpose of introducing improved hydrophobicity, hydrophilicity, or surface reactivity. In particular, the formation of micro-scale plasmas is of importance in the management of dried fluid deposits, such as those coming from inks, to improve the reliability of printing system startup and shutdown sequences and to improve the overall reliability of the printing system.

A micro-scale plasma (also called micro-scale discharge) is generated by providing electrodes through which energy is coupled from an external supply to a region where the micro-scale plasma is generated. Micro-scale plasma refers to an electrical discharge in a gas where the discharge has at least one dimension less than 1 mm in extent, said extent being determined by the spatially localized luminous region, spatially localized ionized region, the region containing most of the active species of interest (for example, the full width at half the maximum concentration of a particular neutral active species such as atomic oxygen), or the spatial extent of the effect of the micro-scale plasma on the component being processed. The micro-scale plasma region is spatially localized and it is recognized that it is potentially advantageous to translate one or more micro-scale plasmas to effect treatment of one or more additional regions and surfaces on the inkjet printer component of interest for the purpose of introducing improved hydrophobicity, hydrophilicity, or surface reactivity to larger surface areas on the inkjet printer component. It can also be beneficial to translate one or more micro-scale plasmas and optionally the associated electrode structures and power supplies to treat additional inkjet printer components as well.

A contact through which energy is coupled to the plasma is herein referred to as an electrode. A second electrode used to provide reference to a first electrode or otherwise assist in coupling energy to the plasma is herein referred to as a counter electrode. Either the electrode or the counter electrode can be positively or negatively biased and therefore can serve as either an anode or a cathode in a diode discharge. Other types of electrodes include radio frequency antennas and microwave waveguides or applicators. In the case of radio frequency inductively coupled plasmas, conductive traces or wires forming an antenna serve as an electrode. In the case of the split ring resonator of Hopwood et al, the portions of a split ring conductive trace on either side of a discharge gap (the split in the ring) serve as electrode and counter electrode, while the split ring and a ground plane in combination serve as a waveguide.

Referring again to FIG. 5, the electrode 54 can be connected to a power supply 58 and can be driven at an electrical potential with respect to a ground potential or other reference potential. In one configuration, the manifold of the inkjet printhead is held at ground potential. The electrical potential applied to the electrode can be DC or AC and the frequency of the AC potential can vary from Hz to GHz with amplitude from V to kV as limited by dielectric breakdown considerations. Alternately, the electrode can be held at ground potential and the printer component itself can be driven at an electrical potential with respect to the ground potential of the electrode. In yet another alternative configuration, a potential can be applied between an electrode and counter electrode with the inkjet printing component electrically isolated ("floating").

Although elevated voltages can be used to light micro-scale plasmas, it is not desirable to employ voltages above 1 kV to maintain a micro-scale plasma because of the increased possibility of physical damage to printer components. This physical damage is manifest as damage to insulating surfaces as burns or craters caused by dielectric breakdown as well as the liquification of low melting materials that can be used in the construction of the printer component. Damage from electrostatic charge buildup on electrostatically sensitive microelectronics components in printer components can also occur more frequently at elevated voltages. Thus, the use of conventional dielectric barrier discharges in air (sometimes called corona discharge web treatment) known in the art of web conversion, and typically utilizing sinusoidal voltage waveforms with peak-to-peak voltages greater than 5 kV, as a means of generating and sustaining micro-scale plasmas can be used but is not preferred.

Electrodes can be formed from conducting materials (e.g., metals, such as aluminum, tanatalum, silver, gold) or semiconducting materials (e.g., doped silicon, doped germanium, carbon, or transparent highly degenerate semiconductors, such as indium tin oxide, or aluminum-doped zinc oxide). In addition, conducting and doped semiconducting polymers, as well as conducting nanoparticulate dispersions can be useful in electrode construction. Furthermore, the electrodes can be passivated by dielectric coatings (for example, organic dielectrics such as epoxies or polyimide polymers, silicon oxide, silicon oxynitride, silicon nitride, tanatalum pentoxide, aluminum oxide), or they can be embedded in a dielectric material. In addition, combination electrodes are permitted where a conducting material such as a metal or doped semiconductor is passivated or otherwise covered by or embedded in a semiconductor coating having different electrical characteristics where the semiconductor coating determines the electrical conductivity of the electrode.

For treating surfaces of printer device components, at least one electrode is located proximate to the component of interest. Proximate herein refers to distances within 1 cm from the component, including electrodes positioned within said proximate distance without contact to the component, brought into direct mechanical contact with the component, or formed directly on the component (integrated) by microfabrication, thin-film deposition, or lamination processes. In the case of electrodes formed directly on the component or otherwise incorporated into the component, the electrodes are integrated with the printer component. Integrated electrodes can be driven by external circuitry or incorporated into circuitry that is fabricated directly on the component, including active and passive circuit elements formed by techniques known in the art of microelectronics and microelectromechanical systems (MEMS) manufacturing. Proximate electrodes can be driven by either external circuitry or by circuitry that is fabricated directly on the component, including active and passive circuit elements formed by techniques known in the art of microelectronics and microelectromechanical systems (MEMS) manufacturing.

While at least one electrode is required to support a microplasma, one or more microplasmas can be generated by using both odd and even numbers of electrodes depending on the specific application. The electrodes can be single electrodes or an array of electrodes with a single counter electrode or counter electrode array. Furthermore electrodes and electrode arrays can be shaped to optimize the micro-scale plasma generation and treatment effect for a specific component to be treated.

Referring back to FIG. 5, the electrode 54 can have various geometries and can be a wire that is either straight or, shaped, for example, as a loop or coil or some other 2- or 3-dimensional shape. The electrode surface presented to the volume where the micro-scale plasma is formed can have the characteristics of the tip of a wire or it can have the characteristics of an asperity from a three dimensional geometrical construct such as the tip of a pyramid, a surface with roughness features on the micro-scale, or some other 3-dimensional topography. It will be appreciated that the term electrode is also applied to a more complex assembly where a portion of the assembly is electrically conductive and an additional portion of the assembly is nonconductive, such as the case of an insulating rod covered with an electrically conductive coating. In addition, the electrode can have hollow portions such as would be found in an insulating tube wound with wire or otherwise coated with a conductive material such as a metal.

While the micro-scale plasma treatment process is intended to run under ambient conditions, it can be advantageous to control the plasma treatment environment by establishing a gas flow of specific gases. The composition of flowing gases can be selected depending on the desired purpose of the micro-scale plasma. For example, compounds that can be activated to produce condensable species can be provided in the gas admitted to the plasma region in order to effect plasma enhanced chemical vapor deposition of a coating onto the component being treated. If the purpose is to deposit a hydrophobic layer, such as a fluorinated polymer, a suitable fluorine- and carbon-bearing gas can be selected in combination with a suitable carrier gas, capable of conveying the micro-scale-plasma-activated species to the appropriate location for deposition on the inkjet printer component. Other condensable materials well known in the plasma deposition and plasma enhanced chemical vapor deposition art can be similarly produced. For example, silanes, siloxanes, and other gases can be admitted to produce silicon oxide, silicon nitride, or silicone films. Other heteroatomic reactants such as ammonia can be added to the gas admitted to the plasma region in order to produce specific activated species, or gases from the ambient air can be entrained in plasma region to produce reactive species. Furthermore, if the purpose is to remove deposits from a surface of an inkjet printer component, gases known to produce volatile species upon plasma activation and contact with the deposit can be introduced proximate to the micro-scale plasma.

It will be appreciated that a suitable carrier gas is one that does not react substantially with the intended micro-scale-plasma-activated species over length scales and time scales such that useful amounts of said species are transported to the desired location. Some common carrier gases are inert or noble gases, such as helium, neon, and argon. In some instances, molecular gases, such as nitrogen ($N_2$) can be useful carrier gases, depending on the desired purpose of the micro-scale plasma. Additionally, it is known in the art of atmospheric pressure plasmas that noble gases, such as helium, can be used to reduce the applied voltage necessary to ignite and maintain a plasma. Heavier noble gases such as krypton and particularly xenon can be added to the gas composition to alter the emission spectrum radiating from the micro-scale plasma region. The addition of xenon gas to the micro-scale plasma region is particularly useful in achieving enhanced ultraviolet emission from the micro-plasma during operation for such processes as elimination of biofouling debris (debris as a result of surface contamination from microorganisms) as well enhancing oxidative surface processes utilizing ozone or other oxidizing reactive neutral species produced by the micro-scale plasma. It should therefore be appreciated that the selection of the composition of the plasma treatment gas is based on the intended effect on the component, and the micro-scale plasma process can be tailored to clean, activate, or passivate the inkjet printer component surface as desired, and the gas composition can further be tailored to improve the operation and stability of the micro-scale plasma, as well as the efficiency of the micro-scale plasma process.

It is advantageous to operate the microscale plasma treatment process near atmospheric pressure regardless of the gas composition. As used herein, near atmospheric pressure includes pressures between 400 and 1100 Torr, and preferably pressures between 560 and 960 Torr. Process pressures in the higher portion of this range can be achieved by pressurizing a manifold dedicated to providing the treatment gas in the vicinity of the component to be treated or a manifold that might otherwise be used for providing air flow or ink flow in the normal printing process. Similarly, the manifold can be drawn to a reduced pressure in order to draw treatment gas (provided by ambient air or an external gas supply) into the plasma treatment region.

Turning again to the configuration shown in FIG. 5, there can be gas flow in the regions around the electrode and inkjet printer component. For example, gas at ambient pressure can flow around the electrode from all sides to surround the electrode and the printer component. The inside of the printer component, in this case the manifold bore of the inkjet printhead, can be held under reduced pressure to force gas to be drawn through the nozzle bore into the inkjet printhead. Likewise, the inside of the printer component can be held under elevated pressure to force gas through the nozzle bore into the space between the printer component and the electrode. The management of gas flow is for the purpose of maintaining the desired composition and flow of gas proximate to the micro-scale discharge, which is formed proximate to the electrode. It is also recognized that the management of gas flow proximate to the micro-scale plasma (near, around, and through the micro-scale plasma) provides a means to direct reactive species formed by the micro-scale plasma in the gas phase towards an intended location.

Figure 6:
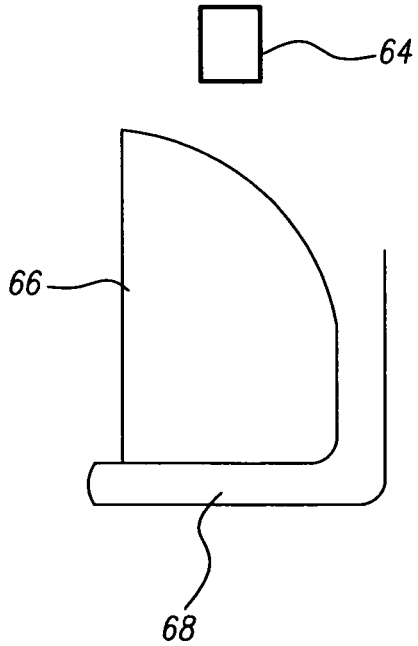
FIG. 6 shows a single electrode positioned over an inkjet gutter printer component.

FIG. 6 illustrates an inkjet printer gutter similar to that shown in FIG. 2 with an electrode 64 positioned above the gutter collection surface 66 or fluid collection surface 66. The electrode 64 is used for the purpose of creating a micro-scale plasma proximate to the inkjet printer component, which in this example is the gutter, proximate herein referring to distances within 1 cm from the component. The formation of a micro-scale plasma proximate to the inkjet printer component can serve many purposes including ensuring initial cleanliness of the surfaces of the inkjet printer component, as well as modification of the surfaces of the inkjet printer component for the purpose of introducing improved hydrophobicity, hydrophilicity, or surface reactivity, and maintaining the surface cleanliness or surface properties during printer use. For example, fluorohydrocarbon, oxides of silicon, carbides of silicon, or nitrides of silicon can be deposited on the fluid collection surface to modify its wetting properties. In particular, the formation of micro-scale plasmas is of importance in the management of dried fluid deposits, such as those coming from inks, which can interfere with the function of the fluid collection surface and the overall operation of the gutter component.

Using micro-scale plasmas to clean and modify surfaces of portions of the gutter component thus enables control of critical surface conditions and thereby improves the reliability of printing system startup and shutdown sequences as well as overall operational reliability. It is recognized that elements of the inkjet printer gutter, for example, the inkjet printer gutter collection surface or the inkjet printer gutter fluid collection channel wall can be employed as electrodes in some configurations. It will be appreciated from the discussion above that the fluid collection channel 68 in the gutter assembly can be used as a means to provide flowing gas to the region proximate to the micro-scale plasma in order to provide the desired stability and chemical or physical effect of the micro-scale plasma.

Figure 7:
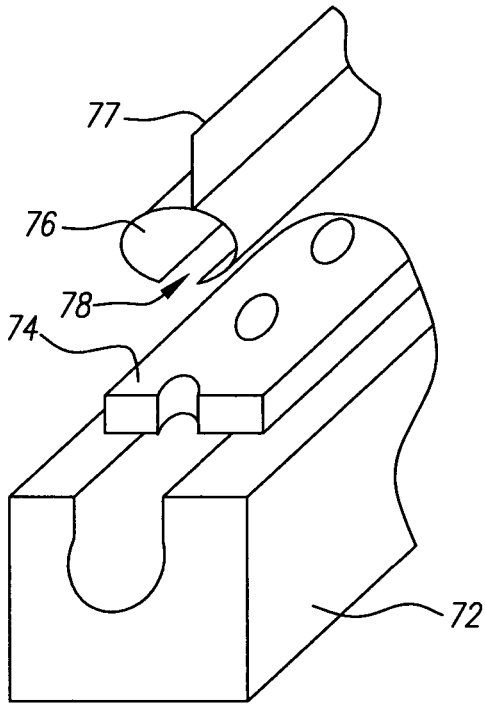
FIG. 7 shows a single split cylinder resonator electrode positioned over an inkjet printhead printer component.

FIG. 7 shows an alternate configuration of a single electrode 76 positioned over an inkjet printer component. The inkjet printer component is an inkjet printhead comprised of a nozzle plate 74 and an attached manifold 72. The single electrode in this case is a three-dimensional split cylinder resonator electrode attached to a planar connector 77. The split cylinder electrode can be constructed so that the outermost layer is conductive. The interior of the electrode can be hollow or filled with a solid dielectric and further include a grounded concentric cylinder that serves as a ground plane and that is connected to a ground plane embedded in the planar connector 77. The planar connector can have a hollow or dielectric-filled volume between its outer conducting surfaces and the embedded ground plane. Alternatively, the ground plane can be comprised of a concentric conductive cylinder external to the split cylinder electrode in combination with planar conductors external to the planar connector.

Furthermore, the connector 77 need not be planar, and the cylinder 76 need not have a circular cross section. The conductive portions of the electrode 76 and connector 77, in combination with the ground plane, serve to guide electromagnetic waves to the gap 78 in the split electrode 76 at the resonant frequency of the split electrode 76 so that they are 180 degrees out of phase on either side of the gap 78. When the interior of the split cylinder resonator electrode is hollow then the interior portion of the electrode can also be used to deliver a flow of gas to the gap in the split cylinder electrode to produce micro-scale plasmas at atmospheric pressure in controlled atmospheres. The advantage of the split cylinder resonator electrode is the ability to create a micro-plasma that is elongated in one dimension, thereby allowing the treatment of multiple regions on the inkjet printer component simultaneously. The split cylinder resonator electrode has an operating frequency determined by the dimensions of the cylinder and can vary from kHz to GHz.

Figure 8:
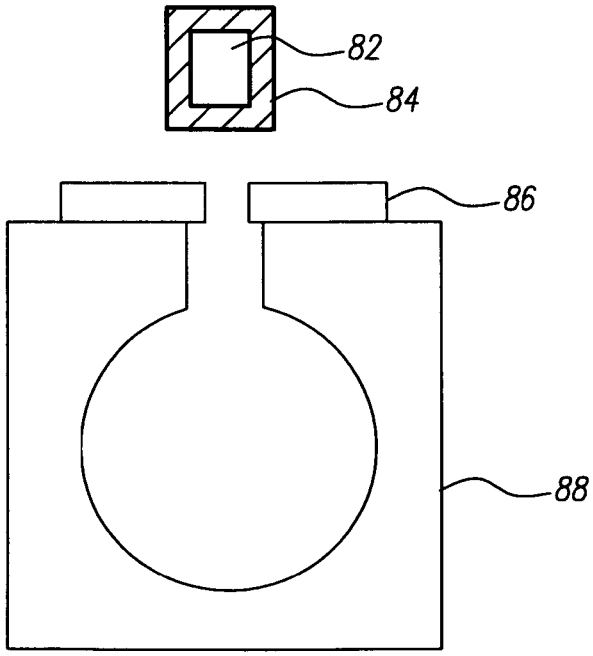
FIG. 8 shows a single electrode coated with a dielectric material and positioned over an inkjet printhead printer component.

FIG. 8 shows a single electrode 82 covered with a coating 84 and positioned above an inkjet printer component. The inkjet printer component in this example is an inkjet printhead comprised of a nozzle plate 86 and an attached manifold 88. The coating on the electrode can have any thickness with a preferred thickness ranging from 10 nm to 10 microns. The coating material can be metallic, semiconducting, or insulating. For example, the coating can be comprised of a corrosion resistant metal such as tantalum or platinum. Alternately, the coating can be comprised of a semiconducting material like silicon carbide or a conducting oxide. The coating can also be comprised of a dielectric material like Teflon, vitreous silicon dioxide, silicon oxide, aluminum oxide or the like. The coating can be a combination of materials or a composite material wherein the term composite denotes a material having two or more (a plurality of) regions with chemically distinct compositions. The coating serves one or more purposes including chemically passivating the underlying electrode material towards highly reactive species formed in the micro-scale plasma as well as influencing the secondary emission characteristics of the electrode (e.g., the coefficient for secondary electron emission by ion impact). The electrode can be either at ground potential or at a potential different from ground potential and can be driven using either DC voltages or AC voltages having amplitudes from 1 volt to 50 kV, as described previously in the description of FIG. 5. When AC voltages are employed, the frequency can be from 1 Hz to 100 GHz with a preferred frequency range from 10 kHz to 10 GHz.

Figure 9:
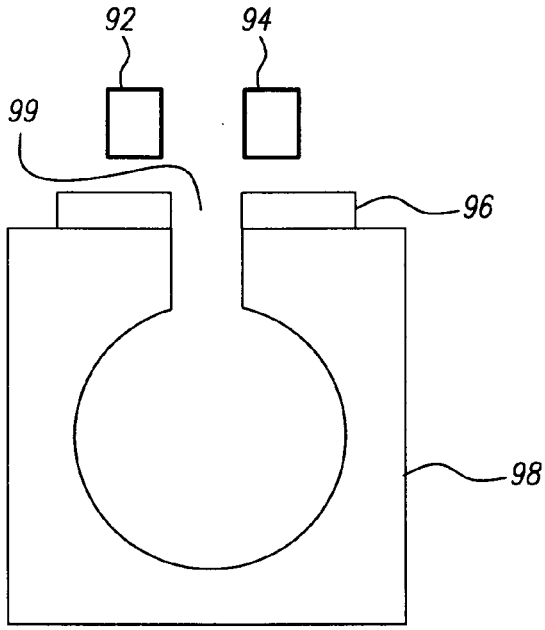
FIG. 9 shows multiple electrodes positioned over an inkjet printhead printer component.

FIG. 9 illustrates a plurality of electrodes 92, 94 positioned above the nozzle plate 96, nozzle bore 99, and manifold 98 of an inkjet printhead component. The electrodes can be as described in FIG. 5 with the difference that there is more than one electrode present and positioned above the inkjet printer component. The electrodes 92, 94 can be electrically driven by the application of a potential. A variety of configurations for applying electrical potentials to a plurality of electrodes are possible. The purpose of applying various electrical potentials to the electrodes is to produce one or more micro-scale plasmas proximate to the inkjet printer component. The electrical potential applied to the electrodes can be DC or AC and the frequency of the AC potential can vary from 1 Hz to 100 GHz with amplitude from 1V to 50 kV as limited by dielectric breakdown considerations. In one electrical configuration, the inkjet printer component can be either held at a reference potential or at ground potential or remain electrically floating. For example, electrode 92 can be electrically driven and electrode 94 can be held at a reference potential or at a ground potential. Depending on the choice of configuration for applying the electrical potential, the micro-scale plasma is produced between electrodes 92, 94 or between each electrode 92, 94 and the nozzle plate 96. For example, electrical potential can be applied between electrodes 92 and 94 to produce a micro-scale plasma in the gap or region between the two electrodes. Species produced in the micro-scale plasma then travel to the proximate regions of the inkjet printer component to effect the intended surface treatment. Pairs of such electrodes can be positioned in correspondence with features in the inkjet printer component (e.g., nozzle bores in a nozzle plate) to produce a plurality of localized micro-scale plasmas for addressing a plurality of features. The application of a suitable reference potential to the inkjet printer component can extend the region of the micro-scale plasma towards the inkjet printer component while still retaining the dimensional scale of the micro-scale plasma to 1 mm or less between electrodes 92, 94. Extending the micro-scale plasma region in one or two dimensions is useful to enhance the efficacy of the atmospheric pressure micro-scale plasma processing for the purpose of, for example, cleaning, surface deposition, or enhancing surface reactivity. Alternatively, a plurality of electrodes 92, 94 can be arranged so that each one is positioned in correspondence with a feature in the inkjet printer component. In this configuration, the plurality of electrodes can be driven together (in parallel) or independently relative to the inkjet printer component to produce localized micro-scale plasmas at each electrode, and electrically conducting portions of the inkjet printer component function as counter electrodes.

Figure 10A:
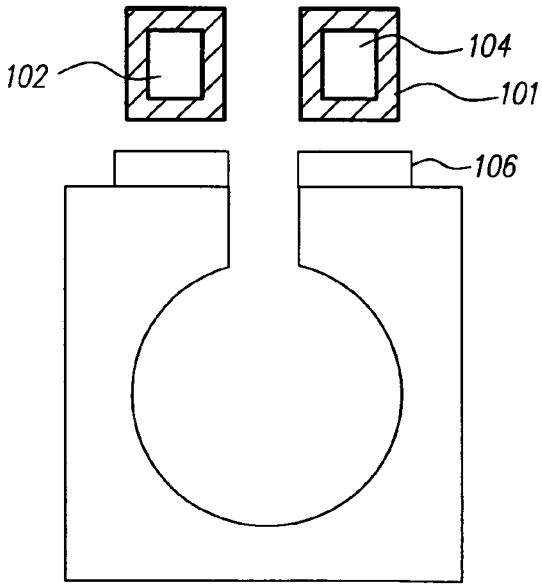
FIGS. 10*a* and 10*b* show multiple electrodes embedded in a dielectric coating positioned over an inkjet printhead printer component.
Figure 10B:
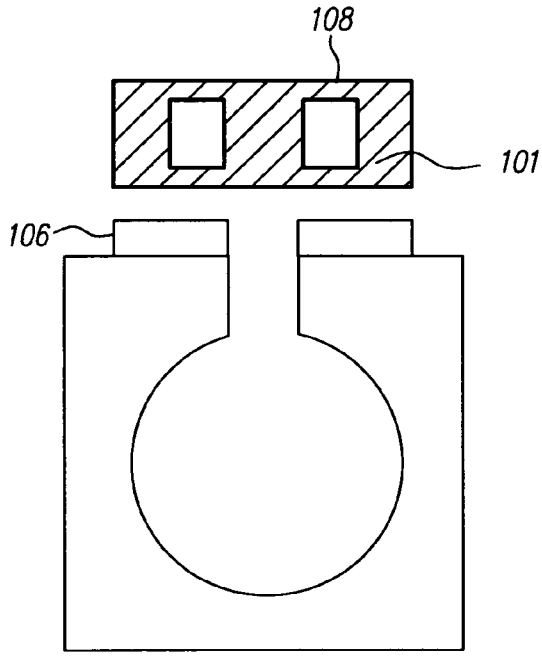

FIG. 10*a* shows an example of a plurality of single electrodes (or multiple single electrodes) 102, 104 where each single electrode is embedded in a dielectric material 101 and positioned over an inkjet printer component. FIG. 10*b* shows a plurality of electrodes 108 embedded in the same single dielectric material 101 positioned above an inkjet printer component. In FIGS. 10*a* and 10*b*, the inkjet printer component is an inkjet printhead with a nozzle plate 106. The term embedded means that the electrode is substantially surrounded by solid or liquid material on all its outer surfaces.

The purpose of embedding electrodes is to protect the electrodes from potentially corrosive micro-scale plasma generated species that could lead to the destruction of the electrode. The dielectric material 101 in which the electrodes are embedded has an electrical resistivity greater than $10^5$ ohm-cm and the thickness of the dielectric material can be any thickness as is appropriate for the micro-scale plasma application and is determined by the operating voltage and dielectric breakdown characteristics of the dielectric material as well as method of electrode manufacture. The dielectric material 101 can be selected from any number of materials with electrical resistivity greater than $10^5$ ohm-cm including: Teflon, epoxies, silicone resins, polyimides, or other low-reactivity thermally stable organic polymers; or carbon containing composite materials where the term composite material refers to a solid containing at least two regions of differing chemical composition. Examples of composite materials are, for example, fiberglass impregnated epoxy or glass fiber reinforced and glass filled Teflon polymer. It will be appreciated that other composite materials are possible and are envisioned to be within the scope of this invention. Some examples of other dielectric materials are: inorganic insulating materials like magnesium oxide and derivative magnesium containing oxides, boron oxide and derivative boron containing oxides, silicon oxide and derivative silicon containing oxides, aluminum oxide and derivative aluminum containing oxides, titanium oxide and derivative titantium containing oxides, tantalum oxide and derivative tantalum containing oxides, niobium oxide and derivative niobium containing oxides, hafnium oxide and derivative hafnium containing oxides, chromium and derivative chromium containing oxides, zirconium oxide and derivative zirconium containing oxides, (insulating binary metal oxides) as well as nitrides, oxynitrides, sulfides and more complex ternary and higher order oxides, nitrides, oxynitrides, and sulfides. The term derivative metal containing oxides means oxide based dielectric compounds containing at least 20 atomic percent of the specified metal. For example the compound zirconium oxide containing 20 percent cerium oxide is a derivative zirconium oxide. It is also a derivative oxide of cerium.

The dielectric material can be crystalline, vitreous, or amorphous. It will be appreciated that other dielectric materials are possible and will be familiar to those skilled in the art of dielectric materials and are envisioned within the scope of the present invention. The dielectric coating can also be textured with asperities or it can be smooth and asperity free. Various types of textured dielectric coatings are possible and are envisioned within the scope of the present invention. As discussed in FIG. 9, the electrodes can be electrically driven in a variety of configurations for the purpose of producing a micro-scale plasma proximate to the inkjet printer component.

Figure 11:
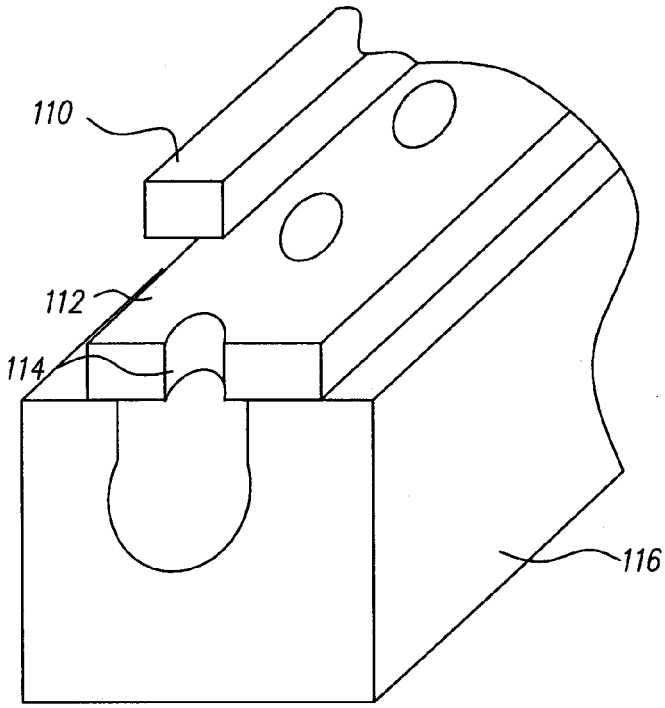
FIG. 11 shows a single electrode in an elongated bar configuration positioned over an inkjet printhead printer component.

FIG. 11 shows an example of an elongated electrode 110 positioned over and proximate to the nozzle plate 112, nozzle bore 114, and manifold 116 of an inkjet printhead component. Although the electrode 110 is shown as rectangular in FIG. 11, other electrode shapes within the scope of this invention are envisioned where the aspect ratio of the elongated dimension of the electrode (substantially lying in the plane parallel to at least one surface of the inkjet printhead component) to at least one of the other two dimensions is greater than 10. For example, the electrode could have the shape of an elongated trigonal prism or some other geometrical construct. The electrode can simply be a length of wire where the diameter of the wire is at least 10 times smaller than the length of the wire lying in the plane parallel to at least one surface of the inkjet printer component. The electrode shown in FIG. 11 can be electrically driven as discussed in FIG. 5 for the purpose of forming a micro-scale plasma region proximate to the inkjet printer component. The use of flowing gas around the electrode 110, as described in the discussion of FIG. 5, including the use of the inkjet printer component itself for the purpose of flowing gas proximate to the inkjet printer component and micro-scale plasma region is also contemplated here.

Figure 12:
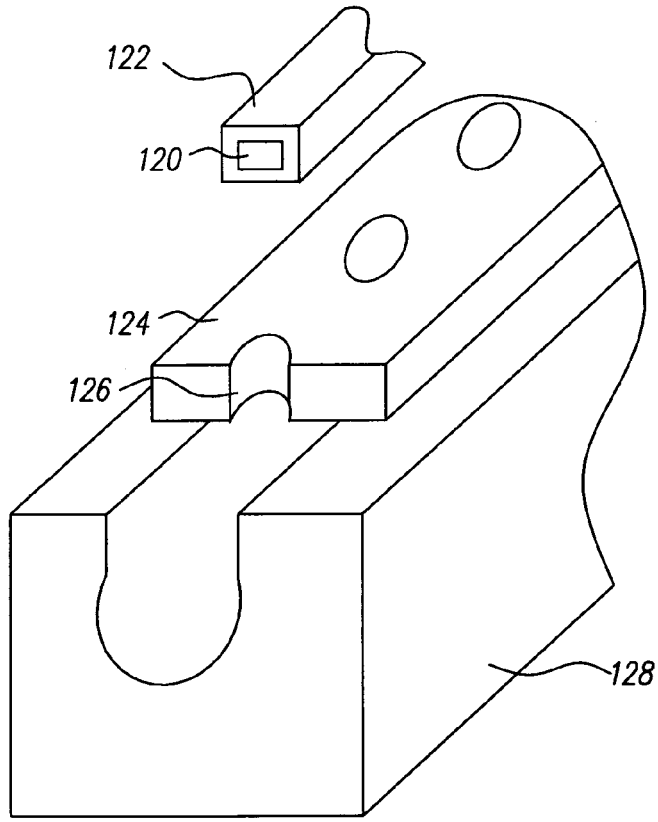
FIG. 12 shows a single electrode in an elongated bar configuration embedded in a dielectric and positioned over an inkjet printhead printer component.

FIG. 12 illustrates an elongated electrode 120, as described in FIG. 11, that is coated with a material 122, as described in FIG. 8, or embedded in a dielectric layer 122, as described in FIG. 10, wherein said elongated electrode is positioned proximate to the nozzle plate 124, nozzle bore 126 and manifold 128 of an inkjet printer component. Other configurations of a coated or embedded elongated electrode are envisioned within the scope of the present invention. Furthermore, configurations involving a plurality of elongated electrodes (coated, embedded, or uncoated) are envisioned within the scope of the present invention, including a pair or a plurality of pairs of electrodes driven with respect to one another to form a micro-scale plasma in the gap between the elongated electrodes in each pair and proximate to the inkjet printer component.

Figure 13A:
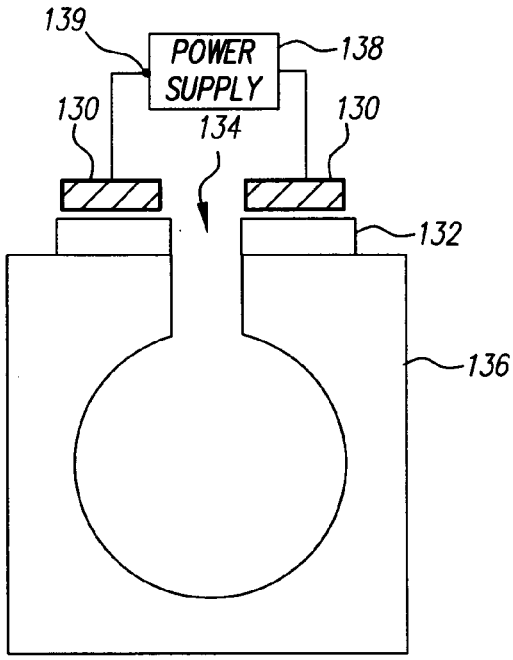
FIG. 13*a* shows an inkjet printhead printer component with multiple single electrodes integrated in an inkjet printhead printer component.
Figure 13B:
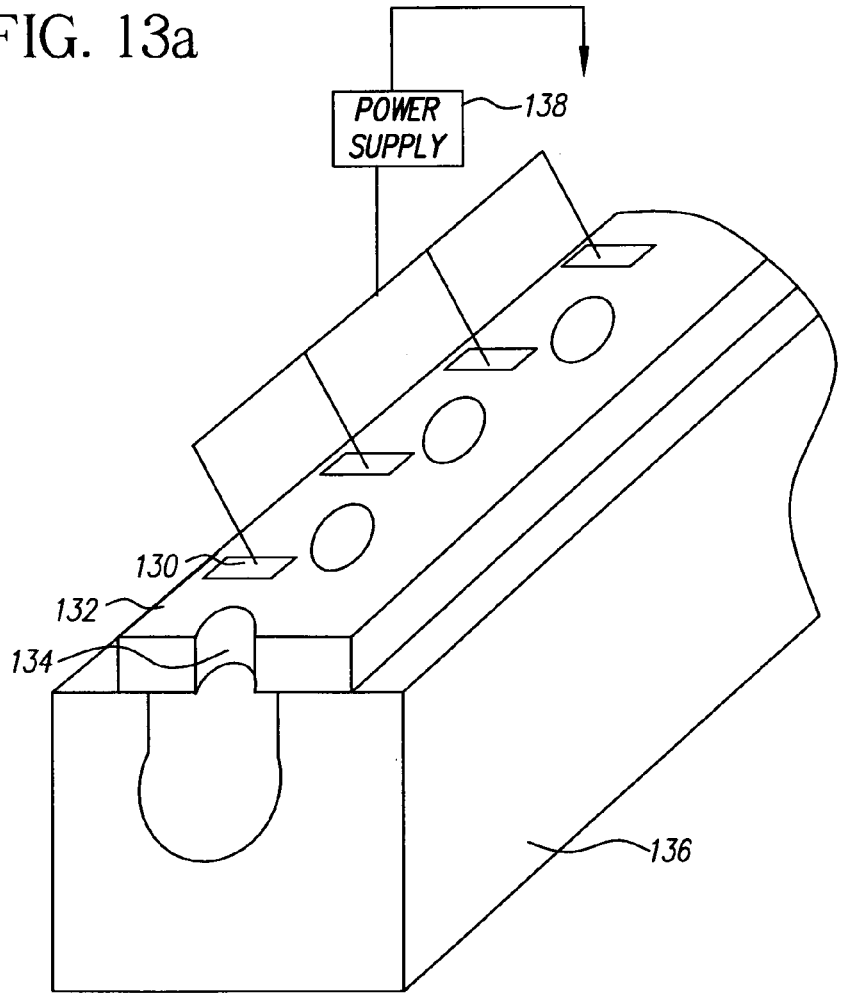
FIG. 13*b* shows an alternate configuration of multiple electrodes integrated in an inkjet printhead printer component.
Figure 13C:
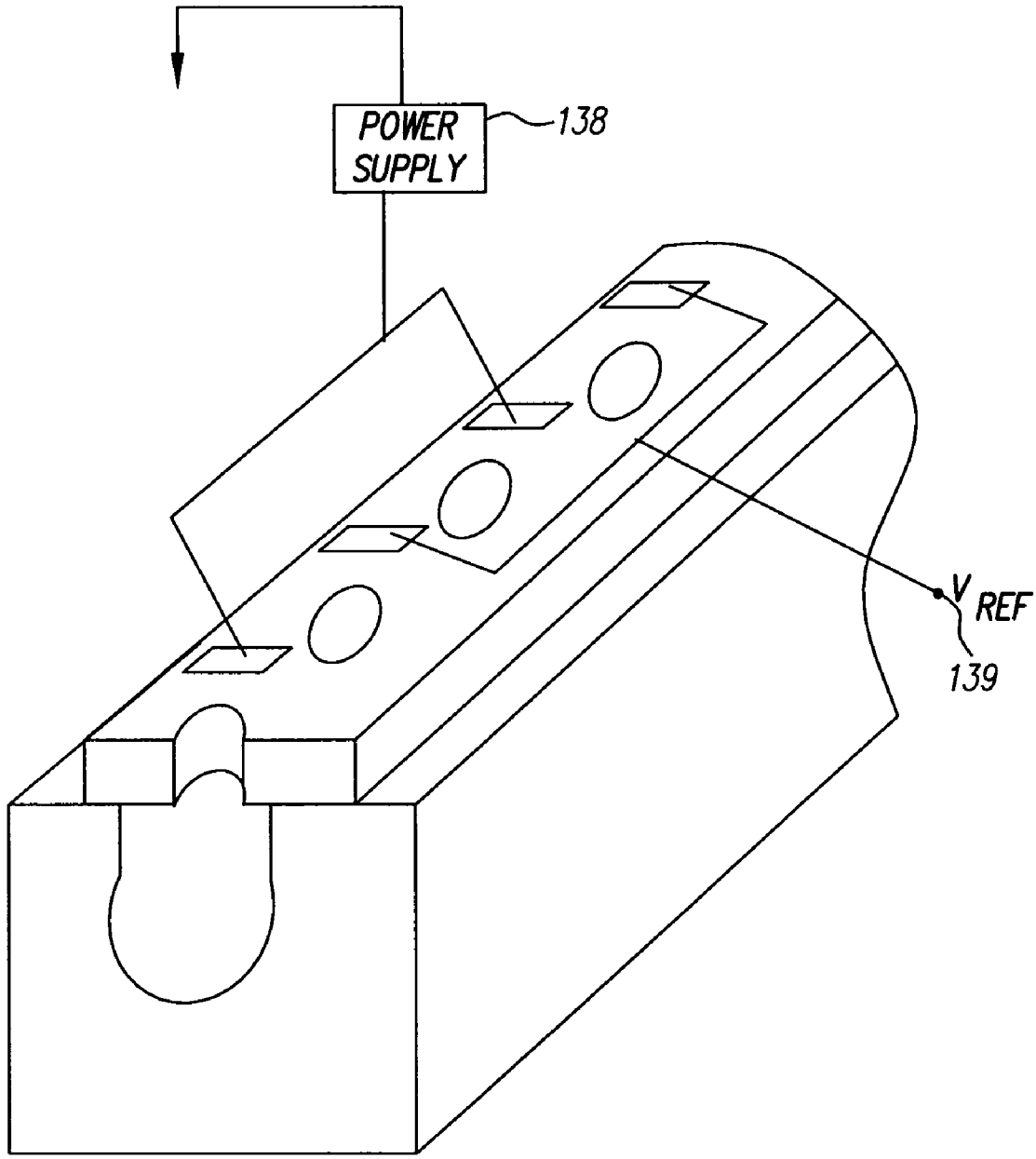
FIG. 13*c* illustrates an electrical connection scheme for driving integrated electrodes on an inkjet printhead printer component for producing micro scale plasmas at the surface of the nozzle plate.

FIGS. 13*a*, 13*b*, and 13*c* illustrate various configurations of electrodes and counter electrodes that are integrated into an inkjet printer component known as an inkjet printhead. The term integrated as employed here means to arrange and fabricate constituent parts to form an inseparable whole. In FIGS. 13*a*, 13*b* and 13*c*, a plurality of electrodes 130 are integrated with the inkjet printhead nozzle plate 132 proximate to the nozzle bore 134 and manifold 136. Integrated electrodes 130 can be passivated or embedded with dielectric material as discussed in FIGS. 8, 10, and 12.

Examples of electrical driving circuitry 138 for the purpose of producing micro-scale plasmas proximate to the inkjet printer component are also shown in FIGS. 13*a*, 13*b*, and 13*c* and it is recognized that other configurations of electrodes and driving circuits are possible and envisioned within the scope of this invention. FIGS. 13*a* and 13*b* illustrate various views of a plurality of electrodes integrated on a nozzle plate and electrically driven through external circuitry, for example a power supply. It is recognized that with the advent of miniaturization of high power devices that the entire power supply can be integrated onto the inkjet printhead component as well, and this is envisioned within the scope of this invention. The electrodes can be driven in a variety of configurations as described in FIGS. 5, 7, and 9 and it is recognized that other electrical configurations are possible and fall within the scope of this invention. In FIG. 13*a*, an electrode and a counter electrode are driven against each other using electrical circuitry.

FIG. 13*b* illustrates a plurality of electrodes driven relative to an external reference. The electrodes can be RF antennae or microwave waveguides similar to those described in U.S. Pat. No. 5,942,855 and US Patent Application Publication No. 2004/0164682 A1 by Hopwood et al. where the gap of the microwave guide electrode or the region of localized RF energy from the RF antennae electrode is located proximate to the nozzle bore 134. Alternatively, the electrodes can be electrically driven relative to a counter electrode, which in FIG. 13*b* can be another part of the inkjet printer component such as the manifold 136, or it can be an external counter electrode, which is not shown in FIG. 13*b*.

FIG. 13*c* illustrates a plurality of electrodes and counter electrodes integrated into an inkjet printer component called an inkjet printhead. The total number of the integrated electrodes can be odd or even. FIG. 13*c* also shows a configuration for driving said integrated electrodes where every other electrode is connected to a terminal 139 held at a reference potential, $V_{ref}$ . . . , relative to the neighboring driven electrodes. $V_{ref}$ is a reference potential which can be a non-zero DC potential or can be grounded by connecting the terminal to ground potential. The potential at the electrodes attached to terminal 139 can be manipulated through modulation Of $V_{ref}$ using methods known to those knowledgeable in the art of plasma generation and consistent with the integrated electrode configuration (for example, number and relative sizes of electrodes and counter electrodes, presence or absence of dielectric material, etc.).

Figure 14:
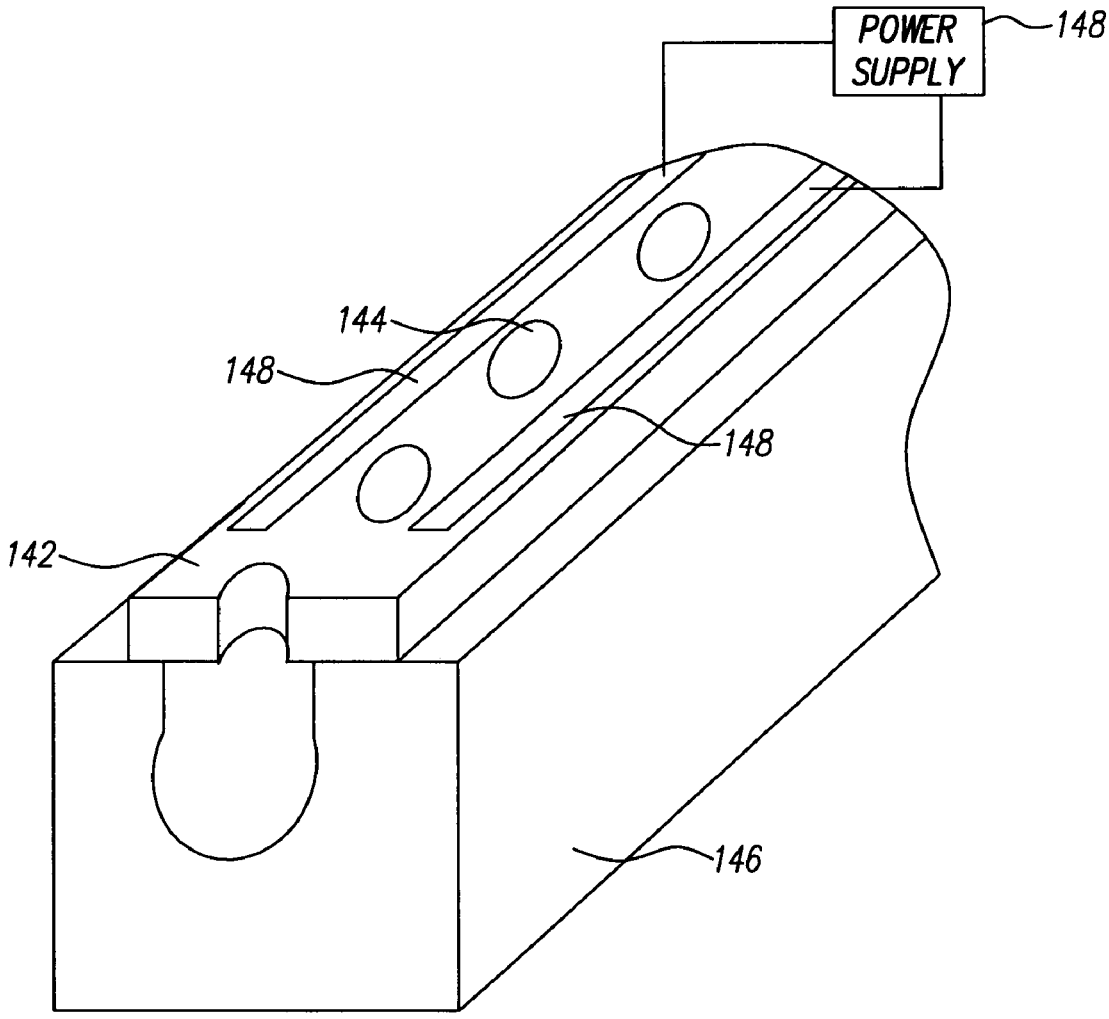
FIG. 14 shows an inkjet printhead printer component with multiple bar electrodes integrated in the inkjet printhead printer component

FIG. 14 shows a plurality of elongated electrodes 140 integrated into the inkjet printer component. A plurality of elongated electrodes 140 as described in FIG. 11 or FIG. 12 is integrated onto the nozzle plate 142 proximate to nozzle bores 144 and manifold 146 and are electrically driven with electrical circuitry 148. It is appreciated that, as discussed in FIGS. 11 and 12, there are a variety of means possible for driving the elongated electrodes for the purpose of producing at least one micro-scale plasma proximate to the inkjet printer component. The electrical circuitry for controlling, producing, and maintaining a micro-scale plasma with a plurality of integrated elongated electrodes is optionally integrated into the inkjet printhead component.

Figure 15A:
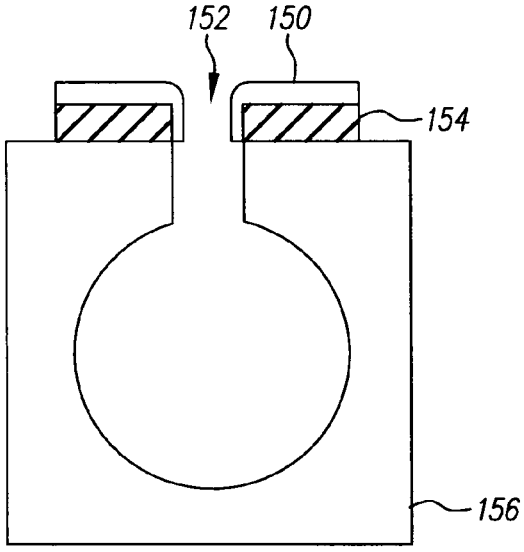
FIG. 15*a* shows an inkjet printhead printer component with electrical device shielding integrated in the printhead printer component.
Figure 15B:
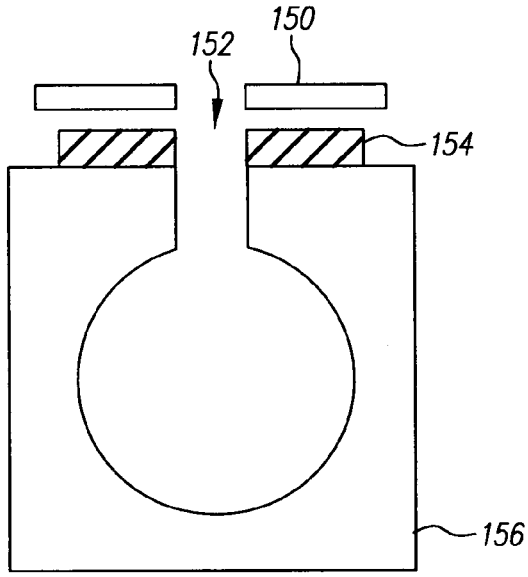
FIG. 15*b* shows an inkjet printhead printer component with electrical device shielding positioned above the printhead printer component.

FIGS. 15*a* and 15*b* show both integrated and non-integrated electrical shielding 150 proximate to a nozzle bore 152 on a nozzle plate 154 and manifold 156 of an inkjet printhead inkjet printer component. Electrical shielding is comprised of an electrically conducting layer that is interposed between a source of electrical noise, such as a micro-scale plasma, and the inkjet printer component where said electrical shield is present for the purpose of improving operational reliability of the inkjet printer component.

The electrical shielding can be fabricated out of any electrically conducting material with a resistivity less than 100 ohm-cm. Typical electrical shielding is fabricated out of metals such as copper, aluminum and aluminum alloys, steel, tantalum and tantalum alloys, gold and gold alloys, silver and silver alloys, niobium and niobium alloys, and titanium and titanium alloys. Transparent conducting materials, such as transparent conducting oxides, can also be used to fabricate electrical shielding. In addition, conductive polymers (for example, polythiophene-based materials) and conductive dispersions of carbon-based materials (for example carbon nanotubes) can be used to fabricate electrical shielding. Nanoparticulate dispersions of conductive materials can also be employed to fabricate electrical shielding.

The electrical shielding can be optionally integrated with the inkjet printer component to improve the inkjet printer component operational reliability. The production of micro-scale plasma can require voltages which exceed the normal operating voltages of the inkjet printer component, or it can produce localized currents that exceed normal operating currents, and an additional purpose of the optionally integrated electrical shielding is to protect the inkjet printer component from damage that could occur if the inkjet printer component was exposed to voltages or currents in excess of the normal operating conditions or in excess of damage thresholds. By interposing the electrical shield between the source of electrical noise, such as a micro-scale plasma, and substantially all potentially sensitive electrical circuitry, including CMOS circuits and other electrical and microelectronic circuitry known to those familiar with the electrical design of inkjet printer components, the inkjet printer component is effectively protected from the source of electrical noise.

The electrical shielding 150 can be connected by any method known to produce electrical continuity with a resistance of less than 10 ohms to a reference potential or a ground potential. Alternatively, there are situations in which it is desirable to allow the electrical shielding to remain unconnected to any reference potential source so that the electrical shield acquires the potential associated with the said source of electrical noise. This configuration is known in the art as electrically floating. For example, if sensitive circuitry can remain electrically floating instead of being grounded, then the circuitry will attain the floating potential, the potential at which a floating contact draws no net charge from the plasma, when exposed to a plasma. In such cases, grounding the shield would create potentially damaging potential between the circuitry and the shield itself and therefore the shield should be allowed to float electrically with the circuitry upon exposure to the source of electrical noise such as a micro-scale plasma. For electrically floating articles, the potential difference between plasma and the article can be significantly reduced relative to the case of a grounded article, and thus, the energies of ions impinging on the article can be significantly reduced. In particular, for capacitively coupled AC discharges, the plasma potential can rise substantially (hundreds of volts) during one half cycle of the applied voltage. By electrically floating a shield and the circuitry being shielded, the potential difference between the plasma and the shield or circuitry will be maintained at a value equal to the potential difference between plasma potential and the floating potential (this difference is typically on the order of 10 volts).

It can be desirable in some applications of micro-scale plasmas to allow the electrical shield interposed between the micro-scale plasma and the inkjet printer component to float and optionally to allow the inkjet printer component itself to float because the floating shield absorbs the ion energy impinging on the surfaces proximate to the micro-scale plasma. This ion energy not only comes in the form of translational kinetic energy but also comes in the form of the energy associated with the ionization potential of the ionized species, said energy from the ionization potential being imparted to the surface with which the ion collides. Although electrical shielding, optionally integrated into the inkjet printer component, is intended to improve operational reliability of the inkjet printer component, it is appreciated that in some electrical configurations employed to drive the electrodes for the purpose of producing a micro-scale plasma proximate to the inkjet printer component, the electrical shielding can perform the additional function of a counter electrode in addition to the primary function of protecting sensitive components on the inkjet printer component for the purpose of improving operational reliability.

Figure 16:
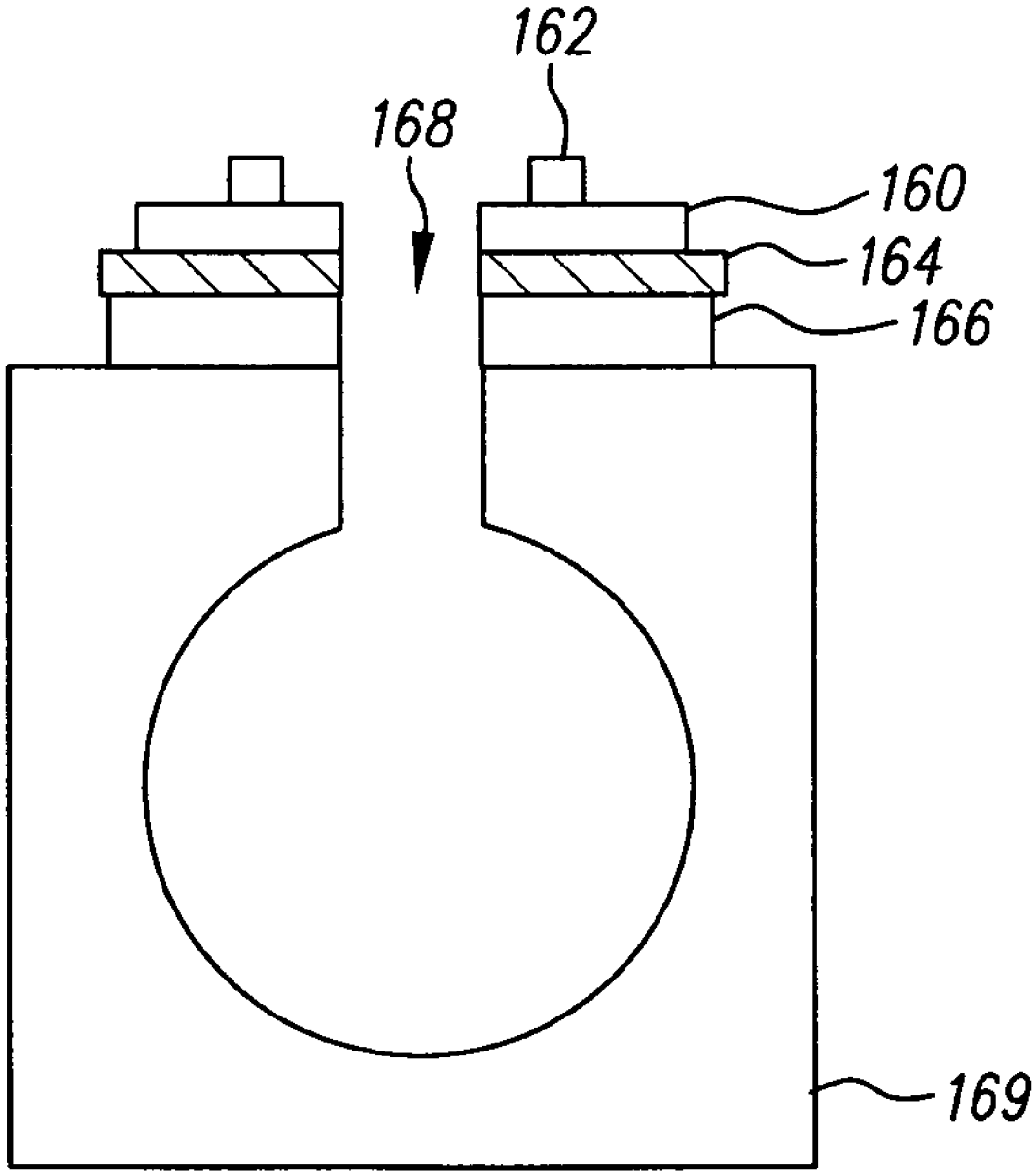
FIG. 16 shows an inkjet printhead printer component with multiple single electrodes and electrical device shielding integrated in the inkjet printhead printer component.

FIG. 16 shows an example of a dielectric layer 160 interposed between a plurality of electrodes 162 and electrical shielding 164 where the electrodes 162, dielectric layer 160 and electrical shielding 164 are integrated onto a nozzle plate 166 proximate to at least one nozzle bore 168 and manifold 169 on an inkjet printhead inkjet printer component. The purpose of the integrated dielectric layer is to electrically insulate the plurality of electrodes from the electrical shielding so that the electrodes do not electrically conduct to the electrical shielding during application of voltage for the purpose of producing a micro-scale plasma proximate to the inkjet printer component. Examples of suitable types of electrical shielding include conductive metals such as gold, copper, aluminum, tantalum, etc., as well as highly doped semiconductor materials such as silicon or polysilicon, doped with phosphorus or boron, doped or otherwise conductive forms of silicon carbide, and doped or otherwise conductive forms of diamond like carbon. Conductive oxide materials such as indium tin oxide, fluorine-doped tin oxide, and aluminum-doped zinc oxide can also be used.

As discussed in FIG. 15, the electrical shielding can be either connected to a ground potential or a reference potential: alternatively, the electrical shielding can remain unconnected to any reference potential and be allowed to acquire the potential induced by the surrounding electrical noise source or allowed to float electrically. The electrodes can be electrically driven for the purpose of producing a micro-scale plasma using any means known in the art of plasma generation and that there are a variety of configurations for electrically driving a plurality of electrodes that can be contemplated and are envisioned to be within the scope of this invention. The plurality of electrodes integrated onto the inkjet printer component can be of a variety of sizes and shapes.

The plurality of electrodes integrated onto the inkjet printer component can be coated with a variety of materials as discussed previously or uncoated, embedded or unembedded, elongated or otherwise extended in at least one dimension. It is also understood that gas flow can be applied to the integrated electrode assembly shown in FIG. 16 as previously mentioned in the discussion of FIG. 5. For example, the manifold 169 can be held at either elevated or reduced pressure relative to ambient for the purpose of influencing gas flow proximate to the micro-scale plasma that is produced proximate to the integrated electrodes 162 on the dielectric layer 160 of FIG. 16.

Figure 17:
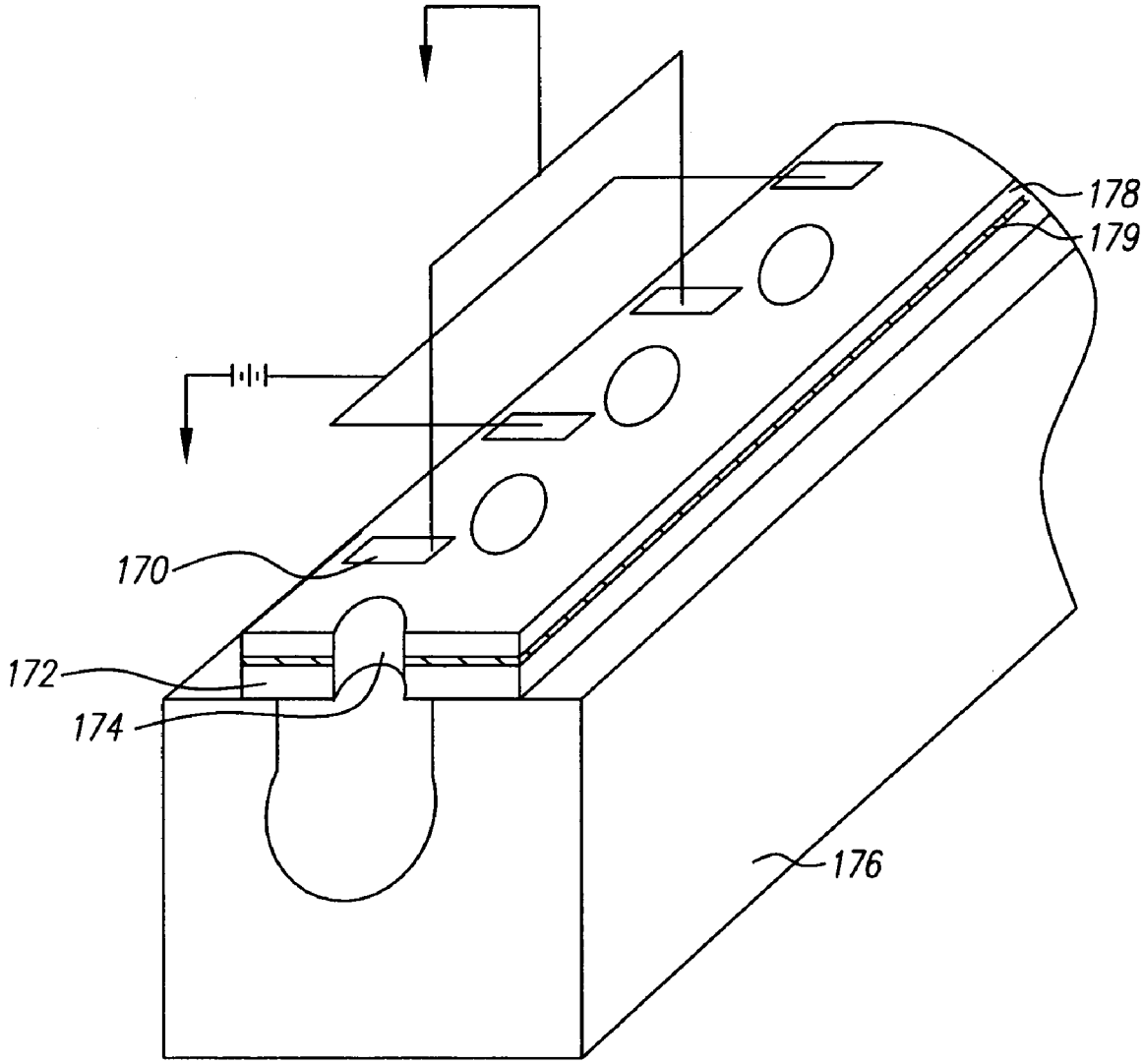
FIG. 17 shows an inkjet printhead printer component with multiple electrodes and electrical device shielding integrated in the inkjet printhead printer component.

FIG. 17 shows another example of a plurality of elongated electrodes 170 integrated on the surface of nozzle plate 172, proximate to at least one nozzle bore 174. The nozzle plate 172 is affixed to manifold 176. A dielectric layer 178 and electrical shielding 179 are interposed between the plurality of elongated electrodes 170 and the nozzle plate 172.

As shown in FIG. 17, interdigitated electrodes and counter electrodes are integrated in an inkjet printer component. The integrated interdigitated electrodes can be optionally positioned so that the nozzle bore 174 of the nozzle plate 172 is located in the space between at least two of the integrated elongated electrodes. FIG. 17 also shows an example of a configuration for driving the integrated interdigitated electrodes for the purpose of producing a micro-scale plasma proximate to the inkjet printer component. It is recognized that a variety of electric circuits can be used to drive electrodes, including various electrical configurations of the electrical shielding, as has been previously discussed.

Figure 18A:
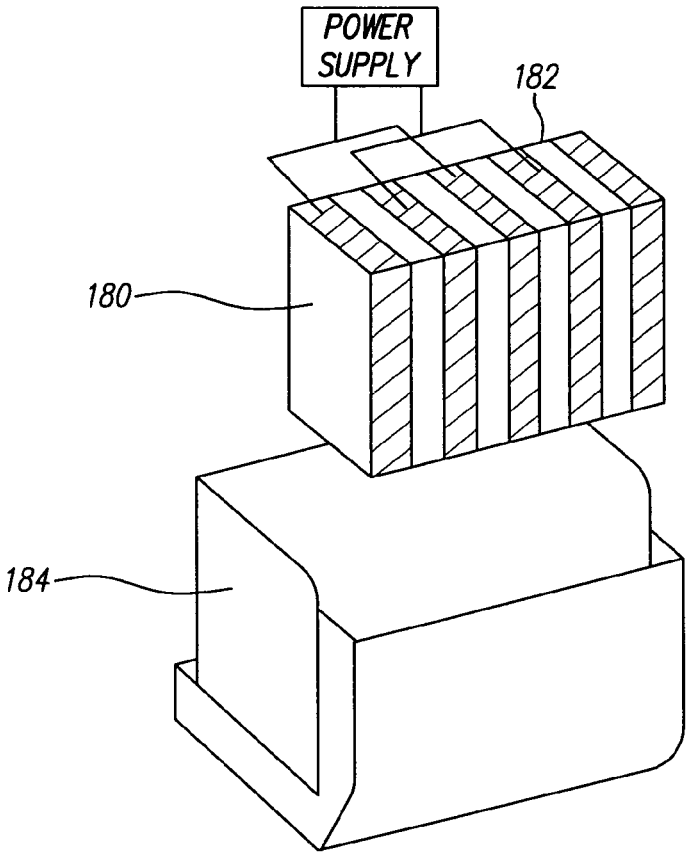
FIGS. 18*a* and 18*b* show an electrically driven assembly of multiple electrodes separated by insulating layers; the assembly is positioned over a gutter inkjet printer component.

FIG. 18*a* shows a composite electrode comprising alternating conductive 180 and dielectric 182 layers along a direction in a plane parallel to a surface of an inkjet printer component 184. In this example the inkjet printer component is an inkjet printer gutter. In FIG. 18*a*, the electrically conductive layers comprise a plurality of electrodes and counter electrodes and are electrically driven so that every other electrically conductive layer (alternating conductive layers) is electrically driven in parallel fashion by a power supply 185, and the remaining counter electrodes are grounded or otherwise connected to the other side of said power supply. As described above, the power supply can be DC or AC. The spacing of the electrically conductive layers comprising a plurality of electrodes and counter electrodes may correspond to dimensions of importance to printer design, such as the spacing between nozzles on an inkjet printer component.

Figure 18B:
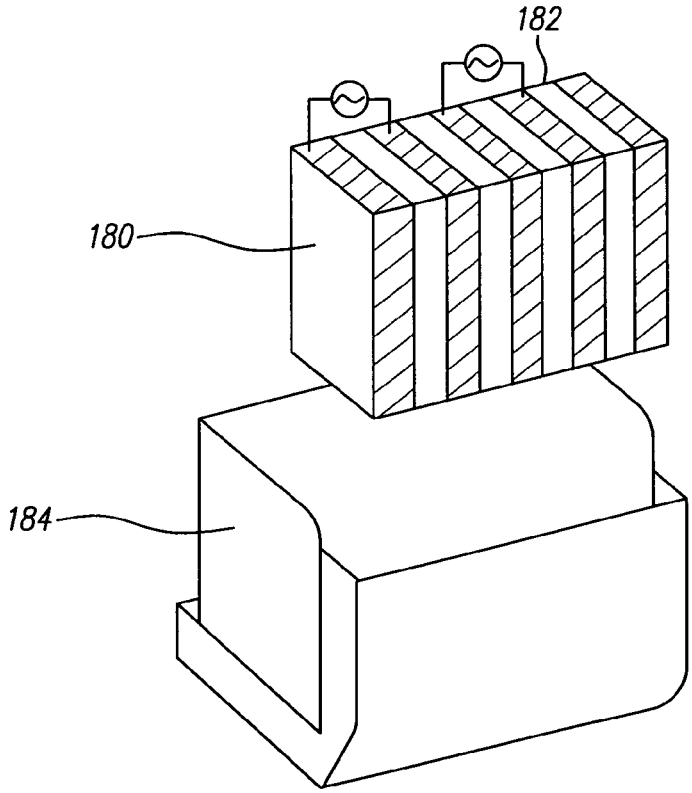

In FIG. 18*b*, electrode pairs 186 are chosen as adjacent conducting layers from the alternating layers of conductive and dielectric layers, where dielectric layers are interposed between each conductive layer, and each specified electrode-counter electrode pair chosen from adjacent conductive layers is independently electrically driven by separate power supplies 188, which can be DC or AC. It is recognized that such a configuration can operate over a wide range of frequencies and that the plurality of power supplies can operate over a plurality of frequencies for the purpose of generating adjacent regions of micro-scale plasma having different characteristics according to the frequency of operation of the chosen electrode-counter electrode pair. Additionally, the dielectric layers need not be continuous and can be spacers instead of solid material, and that a substantial portion of the volume separating conductive layers can be hollow.

FIGS. 19*a* through 19*e* show various example geometries for electrodes used to generate micro-scale plasmas. However, other electrode geometries contemplated for the purpose of producing micro-scale plasma can be integrated appropriately into an inkjet printer component as described in the discussion of FIGS. 13 through 17.

Figure 19A:
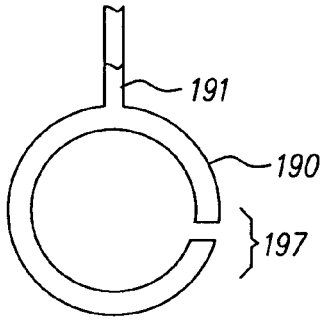
FIGS. 19*a* through 19*e* show various examples of shaped electrodes.
Figure 19B:
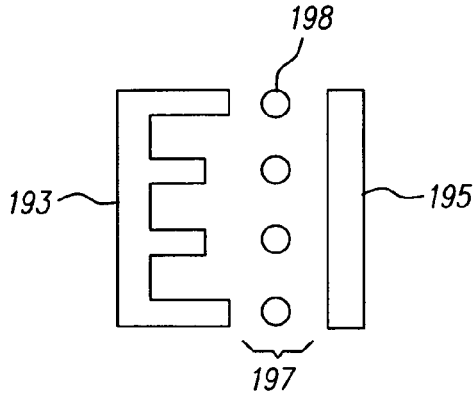
Figure 19C:
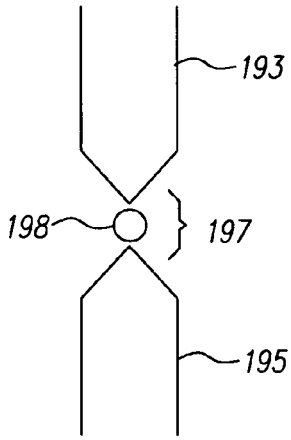
Figure 19D:
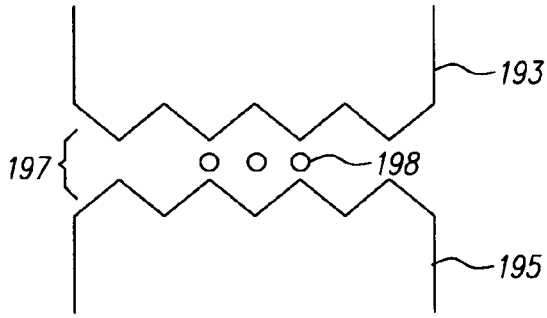
Figure 19E:
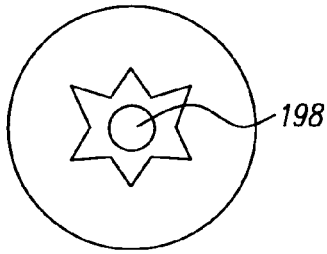

FIG. 19*a* shows a split ring 190 and connector or transmission line 191. FIG. 19*b* shows a patterned electrode 193 with a comb-like structure wherein the protrusions define a gap 197 relative to a counter electrode 195. In this figure, the gap 197 is aligned over an array of nozzle bores 198 on an inkjet printer component (not shown). FIG. 19*c* shows an electrode 193 and counter electrode 195 each having a pointed feature, said pointed features defining a gap 197 between the two electrodes wherein optionally lies at least one nozzle bore 198. FIG. 19*d* shows an electrode 193 and counter electrode 195 each having a plurality of asperities located along the length of the edge of the electrode so as to define a gap 197 having a plurality of regions that are narrower and have more concentrated electric field when a potential is applied across the electrode-counter electrode pair. In FIG. 19*d*, one or more nozzle bores 198 optionally are located within the gap region 197. FIG. 19*e* shows an electrode having a plurality of asperities located around the perimeter of a feature, for example a nozzle bore 198 on an inkjet printer component.

The electrodes and counter electrodes of FIGS. 19*a* through 19*e* can be produced by thin-film deposition and patterning techniques known in the art of microelectronics, microfabrication, and microelectromechanical systems manufacture. Furthermore, they can be stamped from a thin sheet stock or patterned from metal sheets using any technique familiar to those skilled in the art of microfabrication such as electrical discharge machining or chemical etching methods that employ photoresist and etchant solutions.

The electrodes can be fabricated in sheet form and, in particular, structures such as those shown in FIG. 19*a*, FIG. 19*c*, and FIG. 19*d* can be assembled with a dielectric material between the electrodes (or otherwise electrically separated to prevent conduction between said electrodes) to produce a structure or structures as shown in FIG. 18, wherein the gaps between electrode and counter electrode define a region for forming a micro-scale plasma. The multiple gaps between the electrode and counter electrode can be positioned proximate to an inkjet printer component and when driven with suitable electrical excitation can produce an array of micro-scale plasmas in substantially one direction and along a direction lying in a plane substantially parallel to at least one surface of an inkjet printing component.

An assembly of comb electrodes like those of FIG. 19*b* can be similarly stacked and interleaved with dielectric layers to produce a composite electrode that would produce a plurality of micro-scale plasmas in a two-dimensional array, which could be used to address a plurality of features on an inkjet printer component. Depending on the means for applying power to the micro-scale plasma, the electrode configuration might incorporate additional conductive structures. For example, ground planes separated from electrodes by dielectric layers or air gaps can be necessary in order to guide microwaves to the gaps where the micro-scale plasma is generated.

Other combinations of electrodes and counter electrodes, integrated or otherwise, for the purpose of producing micro-scale plasma proximate to an inkjet printer component are permitted. Typically, the choice of a particular electrode geometry is made in accordance with the geometry of the inkjet printer component and its associated features.

As can be appreciated from the prior art, there are a variety of means to produce micro-scale atmospheric pressure plasmas. Hence, in order to produce a micro-scale atmospheric pressure plasma or micro-scale atmospheric pressure discharge, one can choose from a variety of means to couple power to the discharge, a variety of electrode configurations, and a variety of treatment gas. The combination of power supply, impedance matching device, electrode and component configuration, and treatment gas should produce a micro-scale atmospheric pressure plasma in the normal or abnormal glow regime that is sufficiently stable that it does not become an arc. The glow-discharge plasma regime is characterized by distinct regions of uniform glow-like appearance, operating voltages below the break-down voltage, and having negligible slope (normal glow) or positive slope (abnormal glow) to the voltage-current characteristic (see for example Electrical Discharges in Gases, F. M. Penning, Gordon and Breach, New York, 1965, p. 41). The glow discharge regime has lower operating voltage and higher current density (therefore, higher plasma density) than the Townsend regime and is more stable and exhibits less electrical noise and associated interference than the arc regime, which is characterized by considerably higher current density and lower operating voltage.

The invention has been described in detail with particular reference to certain preferred embodiments thereof, but it will be understood that variations and modifications can be effected within the scope of the invention.

PARTS LIST

8 printhead
10 nozzle plate
12 bore
14 slot
16 manifold
18 nozzle bore
19 gutter
20 collection surface
22 fluid collection channel
24 fluid collection channel wall
26 drain
28 drop deflector
30 inkjet printhead
32 charging electrode
34 deflection electrode
36 gutter
40 drop deflector
42 inkjet printhead
43 gutter
45 gas supply manifold
46 gas removal manifold
52 inkjet printhead
54 electrode
56 nozzle plate
58 power supply
64 electrode
66 gutter collection surface
68 fluid collection channel
72 manifold
74 nozzle plate
76 electrode
77 planar connector
78 split cylinder resonator gap

82 electrode
84 coating
86 nozzle plate
88 manifold
92 electrode
94 electrode
96 nozzle plate
97 manifold bore
98 manifold
99 nozzle bore
102 electrode with dielectric layer
104 electrode with dielectric layer
106 nozzle plate
108 multiple electrodes embedded in a dielectric layer
110 electrode
112 nozzle plate
114 nozzle bore
116 manifold
120 electrode
122 coating or dielectric layer
124 nozzle plate
126 nozzle bore
128 manifold
130 integrated electrodes
132 nozzle plate
134 nozzle bore
136 manifold
138 electrical drive circuitry
140 integrated elongated electrodes
142 nozzle plate
144 nozzle bore
146 manifold
148 electrical circuitry
150 electrical shielding
152 nozzle bore
154 nozzle plate
156 manifold
160 dielectric layer
162 electrodes
164 electrical shielding
166 nozzle plate
168 nozzle bore
169 manifold
170 elongated electrode
172 nozzle plate
174 nozzle bore
176 manifold
178 dielectric layer
179 electrical shielding
180 electrically conductive layer
182 dielectric layer
184 inkjet printer component
185 power supply
186 electrode pairs
188 power supply
190 split ring electrode
191 connector or transmission line
193 patterned electrode
195 counter electrode
196 electrode
197 electrode-counter electrode gap defined by one or a plurality of electrode asperities
198 nozzle bore(s)

The invention claimed is:

1. A method of treating a printer component comprising:
providing an electrode integrated with a printer component to be treated;
introducing a plasma treatment gas in an area proximate to the printer component to be treated; and
treating the printer component by applying power to the electrode thereby producing a micro-scale plasma at near atmospheric pressure, the micro-scale plasma acting on the printer component.

2. The method of claim 1, further comprising:
translating at least one of the printer component and the electrode to treat additional regions of the printer component or another printer component.

3. The method of claim 1, further comprising:
controlling atmospheric conditions in the area proximate to the printer component to be treated.

4. The method of claim 1, the printer component comprising electrical circuitry, the method further comprising:
electrically shielding the electrical circuitry from the power applied during the treatment of the printer component.

5. The method of claim 1, wherein the printer component is at least one of a liquid chamber, a nozzle plate, a gutter, and a nozzle bore.

6. The method of claim 1, further comprising:
providing a counter electrode proximate to the printer component to be treated, wherein applying power to the electrode includes applying power between the electrode and the counter electrode.

7. The method of claim 6, wherein the counter electrode is part of the printer component to be treated.

8. The method of claim 6, further comprising:
providing additional electrodes integrated with the printer component to be treated; and
providing additional counter electrodes positioned proximate to the printer component to be treated.

9. The method of claim 1, further comprising:
providing additional electrodes integrated with the printer component to be treated.

10. The method of claim 1, wherein the electrode includes one of a microwave waveguide and a radiofrequency antenna.

11. The method of claim 1, further comprising:
managing a flow of the plasma treatment gas using the printer component to be treated or another printer component.

12. An inkjet printer comprising:
a printer component; and
at least one electrode integrated with the printer component, the at least one electrode being configured to produce a micro-scale plasma at near atmospheric pressure proximate to the printer component.

13. The printer of claim 12, wherein the printer component includes a printhead.

14. The printer of claim 13, wherein the printhead comprises:
a nozzle bore;
a liquid chamber in liquid communication with the nozzle bore;
a drop forming mechanism associated with one of the nozzle bore and the liquid chamber;
electrical circuitry being in electrical communication with the drop forming mechanism; and
an electrical shield integrated with the printhead positioned to shield at least one of the drop forming mechanism and the electrical circuitry from an external source of power.

15. The printer of claim 14, wherein the electrical shield is grounded.

16. The printer of claim 12, wherein the printer component includes a gutter.

17. The printer of claim 12, further comprising:

a power supply in electrical communication with the electrode and a counter electrode.

18. The printer of claim 12, further comprising:

at least one counter electrode integrated with the printer component.

19. The printer of claim 12, wherein the electrode includes one of a microwave waveguide and a radiofrequency antenna.

* * * * *